US009351090B2

(12) United States Patent
Tachibana et al.

(10) Patent No.: US 9,351,090 B2
(45) Date of Patent: May 24, 2016

(54) METHOD OF CHECKING EARPHONE WEARING STATE

(71) Applicant: Sony Mobile Communications, Inc., Tokyo (JP)

(72) Inventors: Makoto Tachibana, Tokyo (JP); Takashi Shiina, Kanagawa (JP); Tetsuya Naruse, Kanagawa (JP); Yuichi Shirai, Tokyo (JP); Chikashi Yajima, Kanagawa (JP); Susumu Takatsuka, Tokyo (JP)

(73) Assignees: Sony Corporation, Tokyo (JP); SONY MOBILE COMMUNICATIONS, INC., Tokyo (JP)

( * ) Notice: Subject to any disclaimer, the term of this patent is extended or adjusted under 35 U.S.C. 154(b) by 282 days.

(21) Appl. No.: 14/043,957

(22) Filed: Oct. 2, 2013

(65) Prior Publication Data

US 2014/0093088 A1 Apr. 3, 2014

Related U.S. Application Data

(60) Provisional application No. 61/708,902, filed on Oct. 2, 2012.

(51) Int. Cl.

| | |
|---|---|
| ***H04R 29/00*** | (2006.01) |
| ***H04R 1/10*** | (2006.01) |
| *H04R 5/033* | (2006.01) |

(52) U.S. Cl.

CPC ..... *H04R 29/00* (2013.01); *H04R 1/1041* (2013.01); *H04R 5/033* (2013.01); *H04R 2460/07* (2013.01)

(58) Field of Classification Search

CPC ..... G06F 3/017; G06F 3/016; G06F 3/04883; G06K 9/6215; G06K 9/00342; G06K 9/00711; G06K 9/6201; H04M 2250/12; H04M 2250/22; H03G 3/001; H04R 2499/11; H04R 1/38; H04R 5/033; H04R 29/00; H04R 25/652; H04R 2225/63; G10K 2210/1081

USPC ..... 348/272, 302, 107, 334, 58, 309, 311, 348/328, 330, 71.6, 358; 381/107, 334, 381/355, 58

See application file for complete search history.

(56) References Cited

U.S. PATENT DOCUMENTS

| | | | | |
|---|---|---|---|---|
| 7,825,815 | B2 * | 11/2010 | Shears | A61B 5/1127 340/573.1 |
| 8,472,653 | B2 * | 6/2013 | Kon | H04S 1/002 381/17 |
| 2003/0163287 | A1 * | 8/2003 | Vock | A43B 3/0005 702/187 |
| 2010/0053210 | A1 * | 3/2010 | Kon | H04S 1/002 345/620 |
| 2011/0112771 | A1 * | 5/2011 | French | A63B 24/0062 702/19 |
| 2012/0002822 | A1 * | 1/2012 | Peissig | G06F 3/012 381/74 |
| 2013/0307856 | A1 * | 11/2013 | Keane | G10L 21/10 345/473 |

FOREIGN PATENT DOCUMENTS

| | | |
|---|---|---|
| JP | 2002-005675 | 1/2002 |

* cited by examiner

*Primary Examiner* — Akelaw Teshale

(74) *Attorney, Agent, or Firm* — Oblon, McClelland, Maier & Neustadt, L.L.P.

(57) ABSTRACT

An information processing apparatus that detects an output from a 3-axis acceleration sensor included in an earphone unit worn by a user while the user is in a still state; monitors the output of the 3-axis acceleration sensor while a nodding gesture is performed by the user; detects a time when an angle of the nodding gesture reaches a maximum; and determines an earphone wearing state based on the output from the 3-axis acceleration sensor in the still state and the output from the 3-axis acceleration sensor at the time of detecting the maximum nodding angle.

12 Claims, 24 Drawing Sheets

METHOD OF CHECKING EARPHONE WEARING STATE

CROSS REFERENCE TO RELATED APPLICATION

The present application claims the benefit of the earlier filing date of U.S. Provisional Patent Application Ser. No. 61/708,902 filed on Oct. 2, 2012, the entire contents of which is incorporated herein by reference.

BACKGROUND

1. Field of the Disclosure

The present disclosure relates to a method of checking the state of how an earphone equipped with a 3-axis acceleration sensor is being worn by a user, and to an audio playback apparatus that uses such an earphone.

2. Description of Related Art

Typically, headphones are used as an apparatus for the purpose of a user converting an audio signal output from an audio playback apparatus into a sound wave (audible sound), basically to listen to music or other such audio alone. The headphones in this specification are connected to such an audio playback apparatus in a wired or wireless manner, and include monaural types which use a single earphone, and stereo types provided with a pair of left and right earphones. An earphone herein refers to the component of headphones worn so as to bring a speaker close to one of the user's ears.

Hitherto, technology providing audio-based navigation to pedestrians wearing headphones has been proposed (see Japanese Unexamined Patent Application Publication No. 2002-5675). With this technology, the angle of cranial rotation with respect to the direction in which a user is traveling (the front-to-back direction of the user's body) is computed as follows. Namely, established laser range-finding methods are used to detect the shortest distance from the user's left shoulder to the left side of the headphones, and also to detect the shortest distance from the user's right shoulder to the right side of the headphones. Additionally, a sensor worn near the base of the head is used to detect the direction of cranial rotation (right-handed turning or left-handed turning as viewed from above). The angle of cranial rotation with respect to the user's travel direction is computed on the basis of these two shortest distances and the direction of cranial rotation thus detected. The position of the sound source is corrected on the basis of the angle of cranial rotation.

SUMMARY

The present inventors have devised technology that identifies the current orientation of a user's face (the heading in which the face is facing) by equipping an earphone with sensors such as acceleration sensors and geomagnetic sensors for various applications such as audio navigation for pedestrians and games, without using laser range-finding methods like those of the above related art.

By equipping an earphone with sensors such as an acceleration sensor and a geomagnetic sensor, it is possible to detect the current orientation of a user's face while the earphone is being worn on the user's head.

However, in cases where the user casually puts an earphone to his or her ears, due to factors such as the shape and arrangement of the user's ears and ear canals, the orientation of the earphone and the sensors mounted on board the earphone will not necessarily be constant. For this reason, error between the orientation of the sensors and the orientation of the user's face (sensor wearing angle error) may be produced. This error may differ by the type of earphone and by user, but may also differ for the same earphone and user every time the earphone is worn. Although in some cases such error is not particularly large and may be ignored depending on the application, in other cases such error is problematic.

For example, for a first rotational direction about an axis given by the user's forward direction, and a second rotational direction about an axis given by the direction connecting the user's ears, it is possible to statically compute the tilt of an earphone according to gravity detection by an acceleration sensor.

However, the wearing angle error in a third rotational direction about an axis given by the vertical direction (an angle θ) cannot be detected. This wearing angle error in the third rotational direction becomes problematic when attempting to accurately compute the orientation of the user's face.

Additionally, there are cases where it would be advantageous to be able to detect whether an earphone is being worn on the user's left or right ear.

Given this background, the inventor has recognized the need to check the earphone wearing state using an earphone equipped with at least an acceleration sensor.

According to an exemplary embodiment, the present disclosure is directed to an information processing apparatus that detects an output from a 3-axis acceleration sensor included in an earphone unit worn by a user while the user is in a still state; monitors the output of the 3-axis acceleration sensor while a nodding gesture is performed by the user; detects a time when an angle of the nodding gesture reaches a maximum; and determines an earphone wearing state based on the output from the 3-axis acceleration sensor in the still state and the output from the 3-axis acceleration sensor at the time of detecting the maximum nodding angle.

DETAILED DESCRIPTION

Hereinafter, exemplary embodiments of the present disclosure will be described in detail and with reference to the drawings.

In the first exemplary embodiment, it is possible to accurately detect the current orientation of the face of a user wearing an earphone, and use the detected orientation for various controls in applications such as audio navigation and games. Accurately detecting the orientation of a user's face may be conducted by detecting the wearing state and wearing angle of the earphone. Particularly, by detecting the offset angle between the orientation of the user's face on a horizontal plane (the forward direction) and the forward direction of the sensor mounted on board the earphone (a specific axis), it is possible to correct the forward direction determined by the sensor. One example of an application using the orientation of a user's face is audio navigation for pedestrians.

Also, in the second exemplary embodiment, while in a state where an earphone is being worn, it is made possible to detect at the apparatus (or at the earphone) whether the earphone is being worn on the left ear or the right ear.

A shared behavior in both of the exemplary embodiments involves using the user interface or other means of a device connected to the earphone to explicitly prompt the user to make a nodding gesture starting from a state of facing forward.

Hereinafter, a configuration of an audio playback apparatus and a headphone (earphone) shared by both of the exemplary embodiments will be described.

Figure 1A:
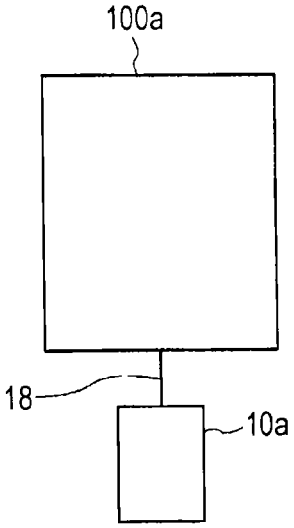
FIGS. 1(*a*)(*b*) are diagrams illustrating a diagrammatic configuration of an audio playback apparatus equipped with a wired and wireless monaural headphone (earphone), respectively.
Figure 1B:
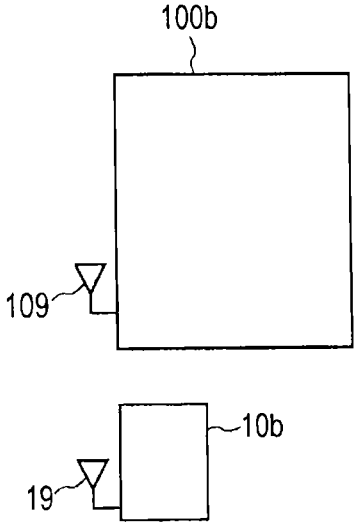

FIGS. 1(*a*)(*b*) illustrate a diagrammatic configuration of audio playback apparatus 100*a* and 100*b* equipped with a wired and wireless monaural headphone (earphone), respectively. A variety of apparatus are known as audio playback apparatus, such as mobile phone handsets, audio players, video players, television sets, radio receivers, electronic dictionaries, and game consoles.

Figure 2A:
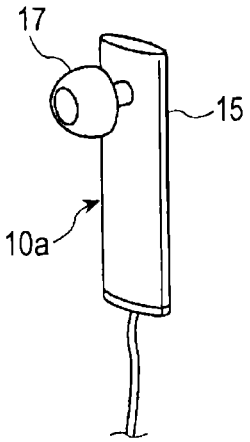
FIGS. 2(*a*)(*b*) are diagrams illustrating an exemplary exterior of a wired and wireless monaural headphone, respectively.
Figure 2B:
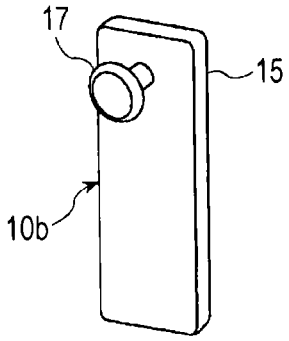

FIGS. 2(*a*)(*b*) illustrate an exemplary exterior of a wired and wireless monaural headphone, respectively. The monaural headphone includes a single earphone 10*a* or 10*b*. The wired earphone 10*a* is connected to the corresponding audio playback apparatus 100*a* via a cable 18. The wireless earphone 10*b* is connected to the corresponding audio playback apparatus 100*b* via a wireless connection interface. In either case, an ear canal plug 17 projecting from the side of the housing 15 is included.

Figure 3A:
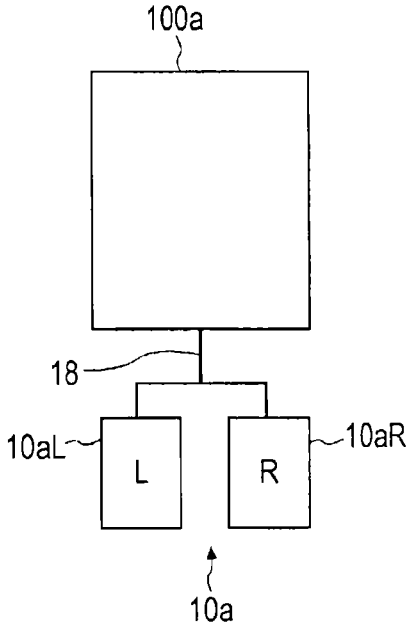
FIGS. 3(*a*) and 3(*b*)(*c*) are diagrams illustrating a diagrammatic configuration of an audio playback apparatus equipped with wired and wireless stereo headphones in the exemplary embodiments, respectively.
Figure 3B:
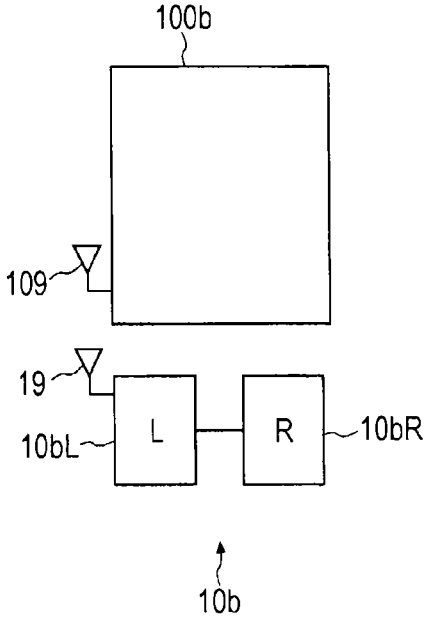
Figure 3C:
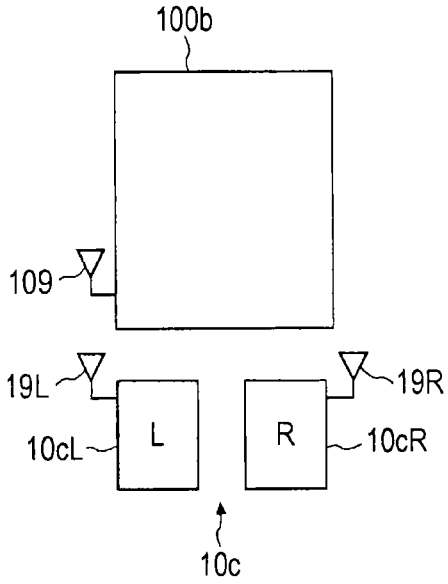
Figure 4A:
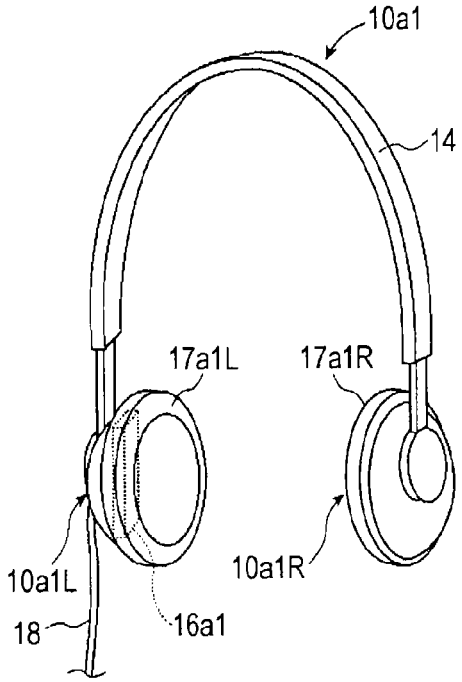
FIGS. 4(*a*)(*b*)(*c*)(*d*) are diagrams illustrating exemplary exteriors of various types of stereo headphones.
Figure 4B:
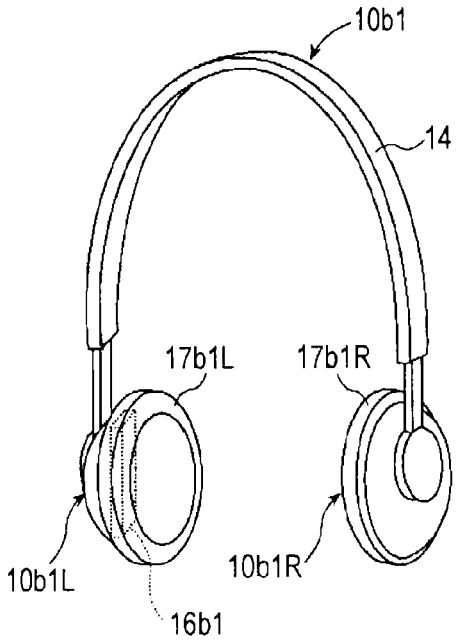
Figure 4C:
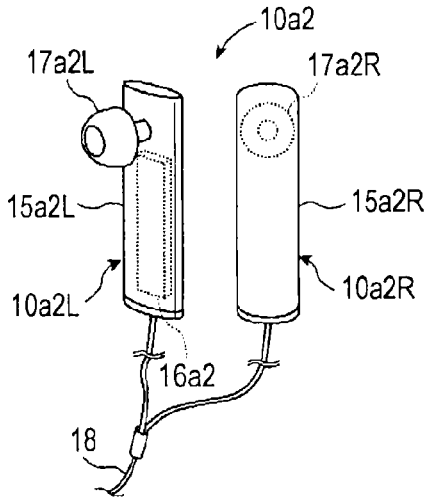
Figure 4D:
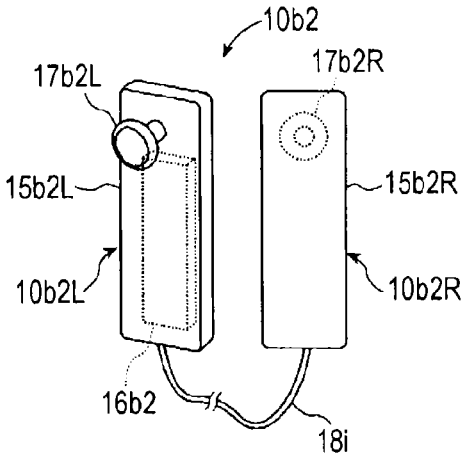

FIGS. 3(*a*) and (*b*)(*c*) illustrate a diagrammatic configuration of audio playback apparatus 100*a* and 100*b* equipped with wired and wireless stereo headphones in the exemplary embodiments, respectively.

The wired earphones 10*a*L and 10*a*R are connected to the corresponding audio playback apparatus 100*a* via a cable 18. The left and right earphones 10*b*L and 10*b*R are wirelessly connected to the audio playback apparatus 100*b* via their antenna 19 and a corresponding antenna 109 in the audio playback apparatus 100*b*. A single antenna 19 may be shared as in FIG. 3(*b*) in the case where the earphones 10*b*L and 10*b*R are joined by a headband or other means as illustrated in FIGS. 4(*a*)(*b*) discussed later. In the case where the left and right earphones 10*c*L and 10*c*R are separated (independent) from each other as illustrated in FIG. 3(*c*), both earphones are separately equipped with antennas 19L and 19R (and communication circuits). In the exemplary embodiments, the orientation detecting unit (sensor) discussed later generally may be provided in only one of the earphones in stereo headphones.

FIGS. 4(*a*)(*b*)(*c*)(*d*) illustrate exemplary exteriors of various types of stereo headphones.

In the wired headphones 10*a*1 illustrated in FIG. 4(*a*), left and right earphones 10*a*1L and 10*a*1R are joined by a headband 14. In one of the earphones (herein, the left earphone 10*a*1L), a sensor device 16*a*1 is installed in its earpad 17*a*1L, and the cable 18 for a wired connection leads out externally. The sensor device 16*a*1 at least houses a geomagnetic sensor 11 and an acceleration sensor 12, discussed later. A wire (not illustrated) for transmitting signals with the other earphone (the right earphone 10*a*1R) passes through inside the headband 14.

In the wireless headphones 10*b*1 illustrated in FIG. 4(*b*), left and right earphones 10*b*1L and 10*b*1R are joined by a headband 14. Similarly to the headphones 10*a*1, a sensor device 16*b*1 is installed in the earpad 17*b*1L of the left earphone 10*b*1L. Unlike the headphones 10*a*1, the sensor device 16*b*1 includes a wireless communication unit (discussed later) in addition to the geomagnetic sensor 11 and the acceleration sensor 12.

FIGS. 4(*c*)(*d*) respectively illustrate headphones (ear receivers) 10*a*2 and 10*b*2 which may be referred to as inner-ear or canal headphones, and which include ear canal plugs

17*a*2L, 17*a*2R, 17*b*2L, and 17*b*2R worn inside the user's ear canal without using a headband.

The wired headphones 10*a*2 illustrated in FIG. 4(*c*) include respective housings 15*a*2L and 15*a*2R, ear canal plugs 17*a*2L and 17*a*2R projecting from their sides, and left and right earphones 10*a*2L and 10*a*2R that include a cable 18 leading out from the bottom of their respective housings. A sensor device 16*a*2 is housed inside at least the housing 15*a*2L of the left earphone 10*a*2L. The sensor device 16*a*2 at least includes the geomagnetic sensor 11 and the acceleration sensor 12.

The wireless headphones 10*b*2 illustrated in FIG. 4(*d*) include respective housings 15*b*2L and 15*b*2R, ear canal plugs 17*b*2L and 17*b*2R projecting from their sides, and left and right earphones 10*b*2L and 10*b*2R that include a cable 18*i* connected between their respective housings 15*b*2L and 15*b*2R. A sensor device 16*b*2 is housed inside at least the housing 15*b*2L of the left earphone 10*b*2L. The sensor device 16*b*2 at least includes the geomagnetic sensor 11, the acceleration sensor 12, and a wireless communication unit (discussed later). The cable 18*i* is unnecessary in the case where both the left and right earphones 10*b*2L and 10*b*2R each include a wireless communication unit independently (this corresponds to FIG. 3(*c*)).

Otherwise, although not illustrated, the exemplary embodiments are also applicable to neckband headphones that include a band hung around the neck as a modification of headband headphones, and to ear clip headphones provided with ear clips, which do not use a band.

Hereinafter, the exemplary embodiments will be described taking headphones of the type illustrated in FIGS. 4(*c*)(*d*) as an example, but the following similarly applies to other types of headphones.

Figure 5A:
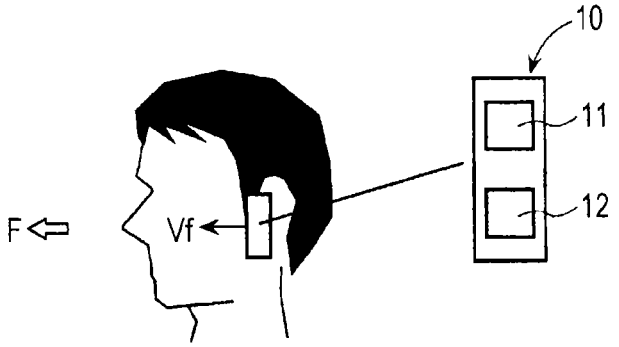
FIGS. 5(*a*)(*b*) are diagrams illustrating states of a user wearing headphones according to the exemplary embodiments.
Figure 5B:
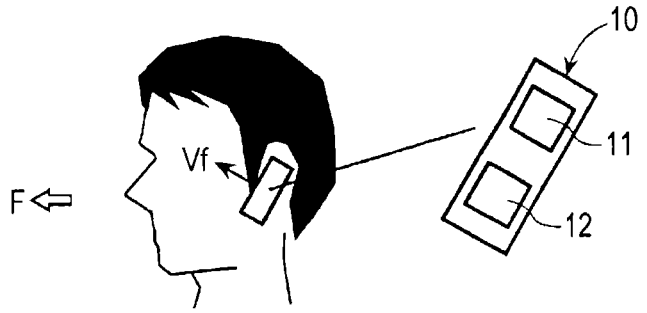

FIGS. 5(*a*)(*b*) illustrate states of a user wearing headphones according to the exemplary embodiments. This example corresponds to the state of wearing a single earphone on the left ear in the case of a monaural headphone, and corresponds to the state of wearing a pair of earphones on the left and right ears in the case of stereo headphones. Hereinafter, the left and right earphones 10L and 10R will be simply designated the earphone 10 when not particularly distinguishing them.

Even in a state of being worn on the user's head, the earphone 10 may rotate within an angular range to some extent, mostly about an axis given by a line joining the left and right ears. FIGS. 5(*a*)(*b*) illustrate states where an earphone 10 is worn on the user's head at different rotational angles. As illustrated, whereas the orientation F of the user's face and the forward direction specific to the earphone 10 (the forward vector Vf) may match in some cases, in other cases they may not match.

For an earphone 10 worn on the user's head as illustrated in FIGS. 5(*a*)(*b*), the direction in which the user's face is facing (the orientation F of the face) may be determined as follows. Specifically, the forward vector Vf of the earphone 10 nearly matches the orientation F of the face in the case where the user is wearing the earphone 10 such that its lengthwise direction is aligned with a direction nearly vertical from the ground (the vertical direction), as illustrated in FIG. 5(*a*). Meanwhile, the actual orientation F of the user's face may still be computed by correcting the forward vector Vf of the earphone 10 on the basis of the sensor output from the acceleration sensor 12, even in the case where a tilt (wearing angle error) is produced in the earphone 10 due to how the earphone 10 is attached to the head, as illustrated in FIG. 5(*b*). Herein, although the rotation of the earphone about an axis given by the direction joining the user's ears is taken to be the problem, an earphone may also potentially rotate in the horizontal plane about an axis given by the vertical direction. This latter rotation in particular affects detection of the orientation of the user's face.

An earphone 10 in the exemplary embodiments (at least one of the left and right earphones in the case of stereo) includes an orientation detecting unit for detecting the current state of the user's head, specifically the orientation F of the user's face, or in other words the direction (heading) in which the front of the head (the face) is facing. It is sufficient for this orientation detecting unit to be mounted on board at least one of the left and right earphones. In the exemplary embodiments, the case of mounting on board the earphone for the left ear will be described as an example.

As discussed earlier, the orientation detecting unit in the exemplary embodiments at least includes a 3-axis geomagnetic sensor 11 and a 3-axis acceleration sensor 12, which are disposed near the ear when worn. In the case of a wireless connection, a wireless communication unit for that purpose is additionally included.

Figure 6:
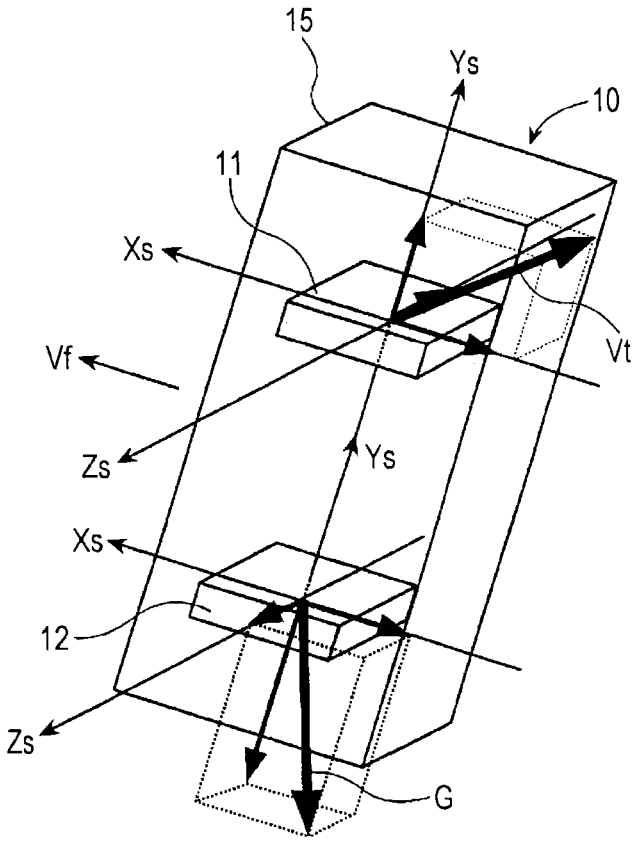
FIG. 6 is a diagram for explaining the respective action of a geomagnetic sensor and an acceleration sensor built into (the housing of) an earphone.

FIG. 6 is a diagram for explaining the respective action of the geomagnetic sensor 11 and the acceleration sensor 12 built into (the housing 15 of) an earphone 10.

The 3-axis geomagnetic sensor 11 ascertains the direction of geomagnetism, or in other words a geomagnetic vector Vt, given the current orientation of (the housing 15 of) the earphone 10 housing the 3-axis geomagnetic sensor 11.

Herein, for the sake of explanation, take an Xs axis, a Ys axis, and a Zs axis to be three mutually orthogonal axes in a local three-dimensional coordinate system specific to the earphone 10 (in other words, specific to the sensor; a sensor coordinate system). The Xs axis corresponds to the front and back direction of the earphone, while the Ys axis corresponds to the top and bottom direction of the earphone. The Zs axis is the axis orthogonal to the Xs axis and the Ys axis. The Zs axis mostly corresponds to the direction along the line joining the user's ears when the user wears the earphone 10. In the case where the earphone 10 is an earphone 10L worn on the user's left ear, an ear-contacting portion (ear canal plug) is disposed on the side of the housing 15 in the negative direction of the Zs axis. Conversely, in the case of an earphone 10R worn on the user's right ear, an ear-contacting portion is disposed on the side of the housing 15 in the positive direction of the Zs axis. The Xs axis is orthogonal to both the Ys axis and the Zs axis. In this example, the positive direction of the Xs axis is taken to match the forward vector Vf of the earphone 10. The geomagnetic vector Vt typically may be decomposed into Xs, Ys, and Zs axis components as illustrated.

The 3-axis acceleration sensor 12 ascertains the direction of gravity, or in other words a gravity vector G, given the current orientation of (the housing 15 of) the earphone 10 housing the 3-axis acceleration sensor 12 in a still state. The gravity vector G matches the downward vertical direction. The gravity vector G likewise may be decomposed into Xs, Ys, and Zs axis components as illustrated.

By using the 3-axis acceleration sensor 12 in this way, it is possible to detect the orientation of the earphone 10 in the three-dimensional space in which (the housing 15 of) the earphone 10 is disposed. Also, by using the 3-axis geomagnetic sensor 11 in this way, it is possible to detect the heading (such as north, south, east, or west) in which the front of (the housing 15 of) the earphone 10 is facing. However, in the exemplary embodiments, it is not necessary to actually compute the heading.

Figure 7A:
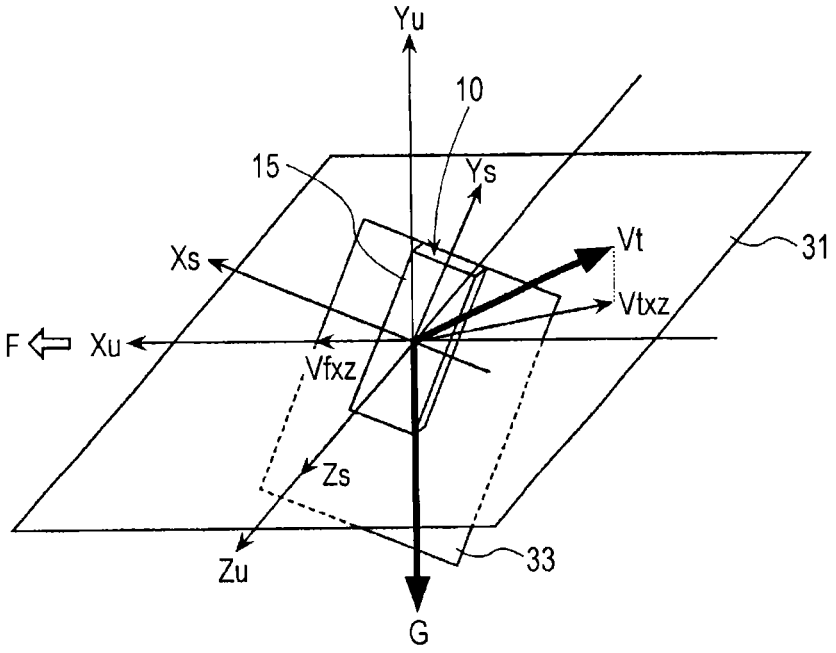
FIGS. 7(*a*)(*b*) are diagrams for explaining relationships of various vectors and various angles in a three-dimensional coordinate system in which an earphone is disposed.
Figure 7B:
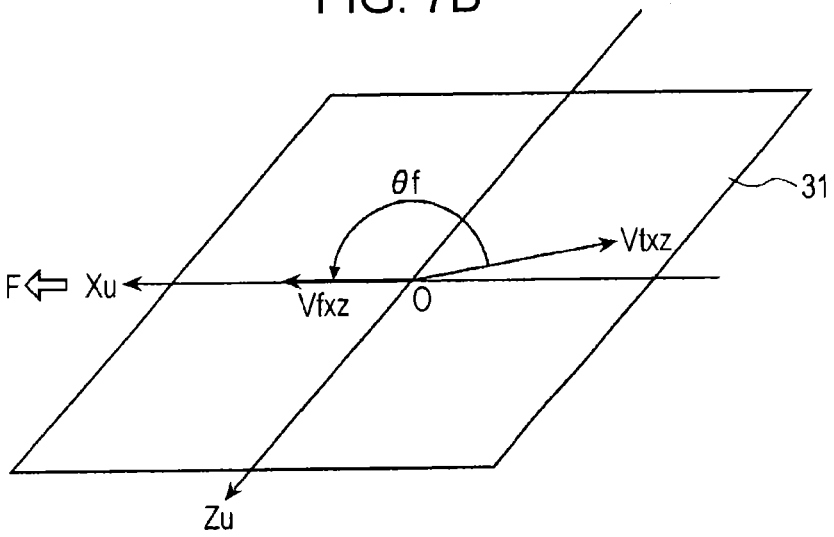

FIGS. 7(*a*)(*b*) are diagrams for explaining relationships of various vectors and various angles in a three-dimensional coordinate system in which an earphone is disposed.

As illustrated in FIG. 7(*a*), take an Xu axis, a Yu axis, and a Zu axis to be the mutually orthogonal axes of a coordinate system for a three-dimensional space in which an earphone 10 is disposed, or in other words, the three-dimensional space where the user is positioned. This coordinate system is called the user coordinate system (Xu, Yu, Zu) to distinguish it from the sensor coordinate system (Xs, Ys, Zs) as above. The variables used in both these coordinate systems will be distinguished with the subscripts s (sensor) and u (user). The Xu axis corresponds to the front and back direction of the user, while the Yu axis corresponds to the top and bottom direction of the user. The Zu axis is the axis orthogonal to the Xu axis and the Yu axis. The negative direction of the Yu axis lies along the gravity vector G. The plane orthogonal to the gravity vector G is the XuZu plane, and corresponds to a horizontal plane 31 in the space where the user is positioned. For the sake of convenience, the Zu axis is taken to match the Zs axis.

As discussed earlier, when the user wears the earphone 10, the top and bottom direction (lengthwise direction) of the earphone 10 does not necessarily match the vertical direction. Likewise, the example in FIG. 7(*a*) illustrates an example where the vertical direction (the direction along the Yu axis) and the Ys axis direction of the sensor coordinate system do not match.

For the sake of convenience, imagine a plane 33 containing a face of the housing 15 of the earphone 10 (the face that comes into contact with the user's ear), as illustrated in FIG. 7(*a*). The direction of the line where the plane 33 and the horizontal plane 31 intersect (the vector Vfxz) may be determined to be the orientation F of the user's face. The orientation F of the face computed in this way may include some degree of error with respect to the exact orientation of the face, due to how the earphone is worn. However, this error is considered to be within an acceptable range for many applications.

As a method of more accurately computing the orientation F of the face, it may be configured such that when the user wears headphones, the user is requested to perform a nodding gesture with his or her head in the forward direction, and the error between the forward direction of the headphones and the orientation of the user's face is computed on the basis of output from the acceleration sensor in a state before the nodding and a state at the maximum nodding angle. In this case, the orientation of the user's face may be detected with higher precision by correcting the orientation of the user's face according to the error. This specific method will be later discussed in detail.

A reference azimuth vector Vtxz is obtained from the geomagnetic vector Vt by projecting this vector onto the horizontal plane 31. The vector Vfxz on the horizontal plane 31 is specified as the vector in the direction of an angle of based on the reference azimuth vector Vtxz.

By using the geomagnetic sensor 11 and the acceleration sensor 12 in combination, it is possible to obtain information on the direction (heading) in which the user (the user's face) is facing which is required for navigation, even when the user is in a stationary state, or in other words even if the user is not moving. Also, sensors of comparatively small size may be used for these sensors with current device technology, and thus it is possible to install such sensors on board an earphone without difficulty.

Figure 8A:
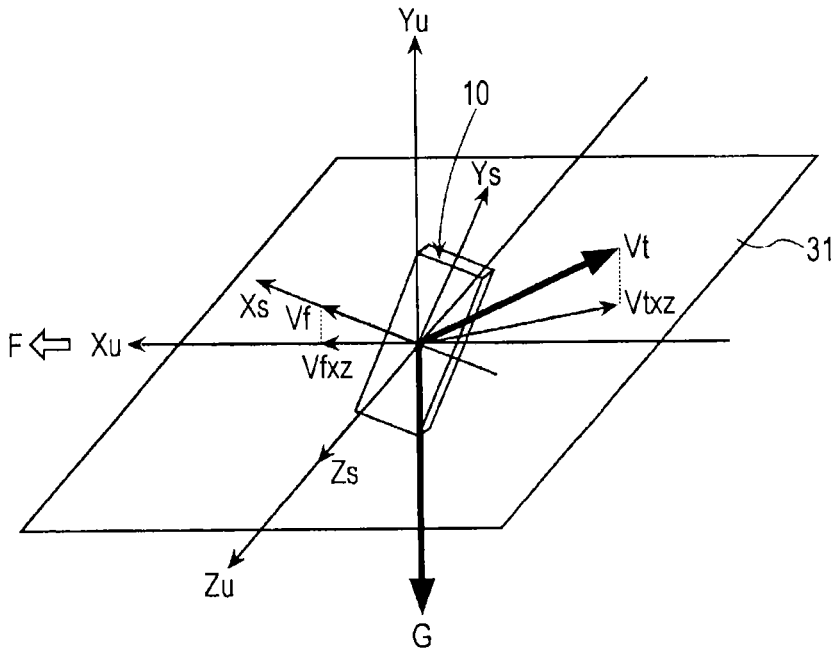
FIGS. 8(*a*)(*b*) are another set of diagrams for explaining relationships of various vectors and various angles in a three-dimensional coordinate system in which an earphone is disposed.
Figure 8B:
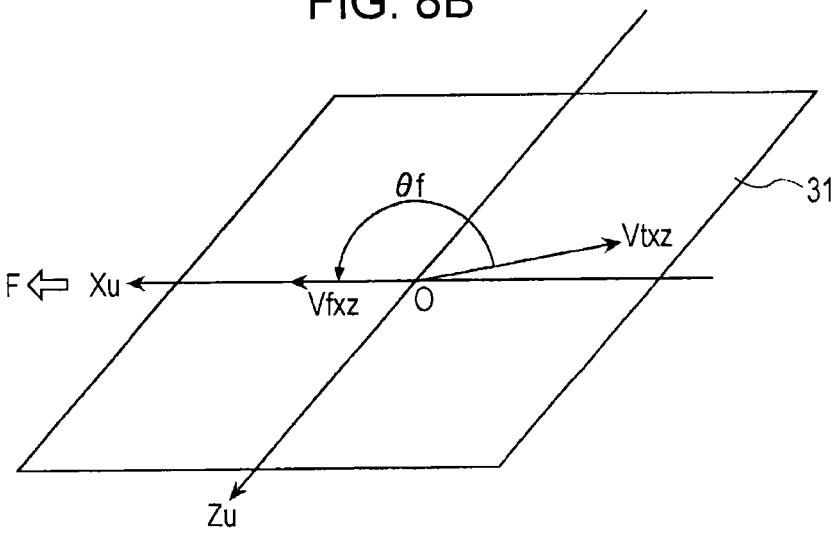

FIGS. 8(*a*)(*b*) are another set of diagrams for explaining relationships of various vectors and various angles in a three-dimensional coordinate system in which an earphone is disposed.

Instead of computing the orientation F of the face as described with FIG. 7(*a*), the forward vector Vf along the X axis direction may also be approximately set, as illustrated in FIG. 8(*a*). In this example, the forward vector Vf matches the positive direction of the Xs axis. The magnitude of the forward vector Vf is arbitrary (or a unit vector). The direction indicated by a vector Vfxz obtained by projecting the forward vector Vf onto the horizontal plane, or in other words the XuZu plane 31, may be determined to be the orientation F of the user's face. The orientation F of the face computed according to the forward vector Vf does not necessarily match the orientation F of the face described with FIG. 7(*a*), and likewise may include error with respect to the exact orientation of the face. However, the orientation F of the face may be computed quickly and easily.

In either case, if the user moves his or her head, the earphone 10 being worn on the head moves together with the head. In response to such movement of the head, the current vertical direction with respect to the earphone 10 (the gravity vector G) is detected at individual points in time. Also, as the head moves, the plane 33 (or the forward vector Vf) in the user coordinate system changes, and a new corresponding vector Vfxz (or orientation F of the face) is determined.

Figure 9A:
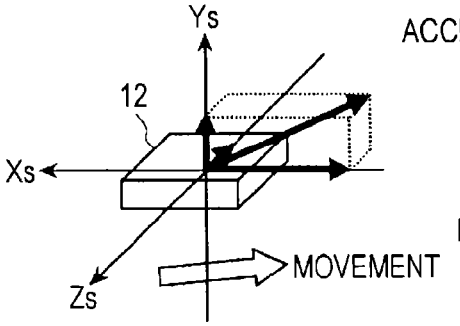
FIGS. 9(*a*)(*b*) are diagrams for explaining action of an acceleration sensor besides detecting a gravity vector.
Figure 9B:
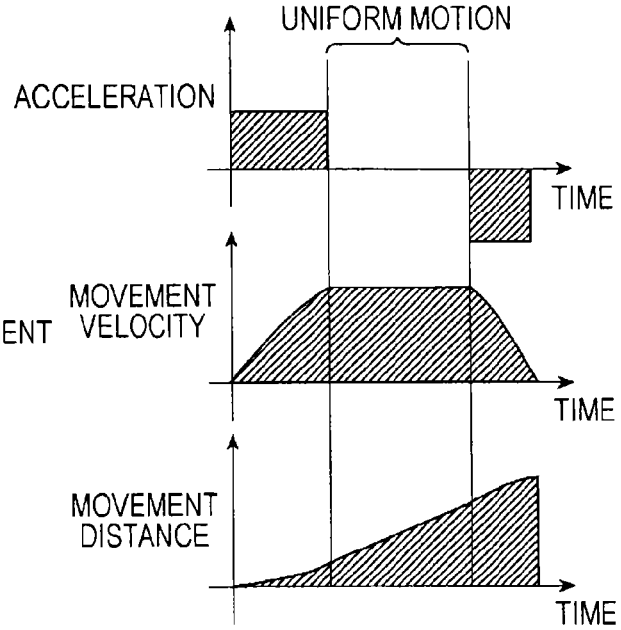

FIGS. 9(*a*)(*b*) are diagrams for explaining action of the acceleration sensor 12 besides detecting a gravity vector.

As illustrated in FIG. 9(*a*), besides detecting constant accelerations such as gravity, the acceleration sensor 12 is also able to detect dynamic accelerations that accompany movement. For example, in the case where an object moves, positive acceleration is imparted to that object from a stationary state, and negative acceleration is imparted when the object stops. For this reason, the acceleration of an object is detected, and from the integral thereof it is possible to compute the movement velocity and the movement distance, as illustrated in FIG. 9(*b*). However, since the acceleration does not change in the case of uniform motion, the movement state cannot be detected unless an acceleration from a stationary state is detected. Also, due to the configuration of the acceleration sensor 12, rotations cannot be detected in the case of rotation about the gravity vector as axis.

Figure 10A:
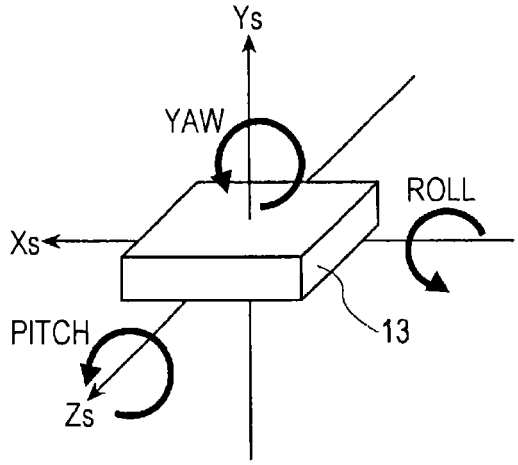
FIGS. 10(*a*)(*b*)(*c*) are diagrams for explaining an example of jointly using a gyroscope as a sensor.
Figure 10B:
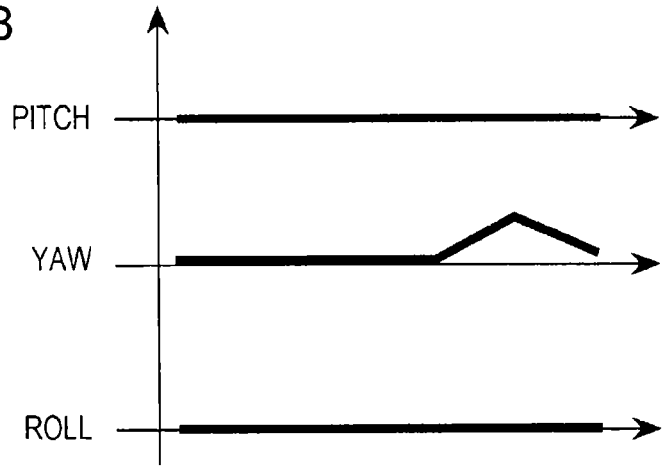
Figure 10C:
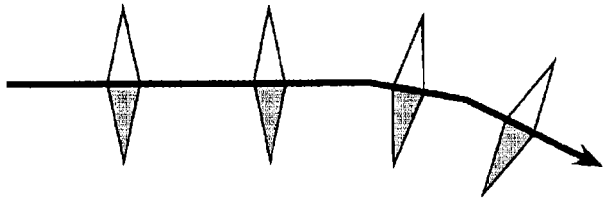

In contrast, FIGS. 10(*a*)(*b*)(*c*) will be used to explain an example of jointly using a gyroscope 13 as a sensor.

As illustrated in FIG. 10(*a*), the gyroscope 13 is a sensor that detects angular velocity about the three axes Xs, Zs, and Ys (roll, pitch, and yaw), and is able to detect the rotation of an object. In addition, the geomagnetic sensor 11 is able to ascertain the heading in which the object faces, on the basis of a geomagnetic vector as discussed earlier. However, in cases where the magnetic field lines are not in a constant direction, such as when near a magnetized steel frame, it may become impossible to recognize the correct heading in some cases when the object rotates while moving. For this reason, the rotational state may be detected with the gyroscope only in cases of movement like that illustrated in FIG. 10(*c*). Herein, the object is represented by a compass needle for the sake of convenience.

Consequently, by jointly using a gyroscope 13 together with the above geomagnetic sensor 11 and acceleration sensor 12 as sensors installed on board an earphone 10, it may be configured to supplement the output from both sensors.

In this way, although it is possible to detect the orientation F of the user's face in real-time and with some degree of precision using only a geomagnetic sensor and a acceleration sensor 12, by jointly using a gyroscope (gyro sensor) it becomes easy to track even comparatively fast changes in direction by the user.

Figure 11:
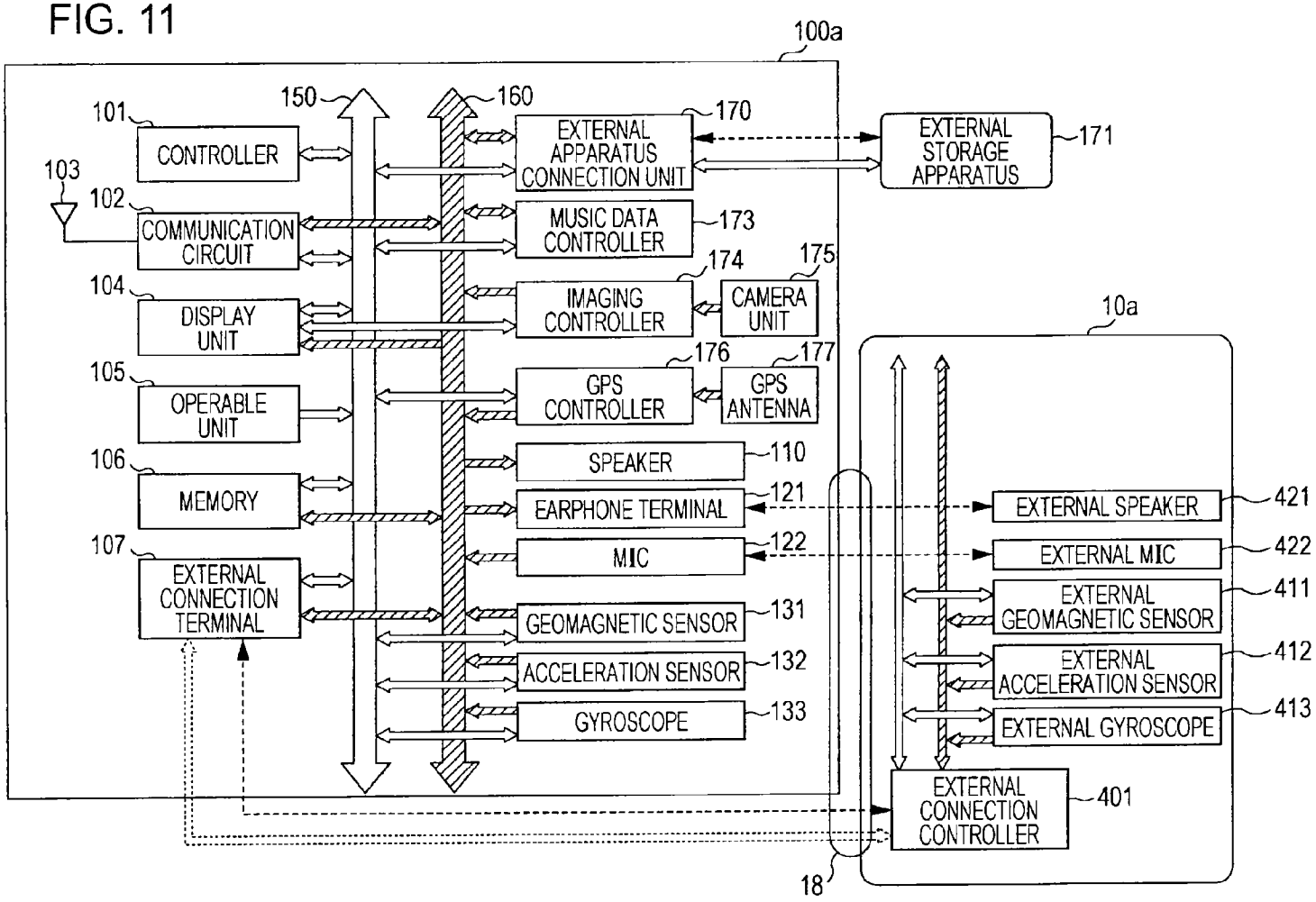
FIG. 11 is a block diagram illustrating an exemplary configuration of an audio playback apparatus in the exemplary embodiments.

FIG. 11 is a block diagram illustrating an exemplary configuration of an audio playback apparatus 100*a* in the exemplary embodiments. The audio playback apparatus 100*a* is taken to be what is called a mobile device as an example, and is equipped with a wired, monaural earphone 10*a*. A headphone provided with an earphone with attached microphone is typically called a headset. Although a microphone was not particularly illustrated in the block diagrams or exterior views of the various earphones discussed earlier, a microphone may be built in. Although a microphone may be housed inside the earpads 17*a*1 and 17*b*1 or the housing 15, it is also possible to dispose a microphone projecting outward therefrom or partway along the cable 18.

The audio playback apparatus 100*a* includes a control line 150 and a data line 160, and is configured by various functional units like the following, which are connected to these lines.

The controller 101 is composed of a processor made up of a central processing unit (CPU) or the like. The controller 101 executes various control programs and application programs, and also conducts various data processing associated therewith. In the data processing, the controller 101 exerts communication control, audio processing control, image processing control, various other types of signal processing, and control over respective units, for example.

The communication circuit 102 is a circuit for wireless communication used when the audio playback apparatus 100*a* communicates with a wireless base station on a mobile phone network, for example. The antenna 103 is a wireless communication antenna used when the audio playback apparatus 100*a* wirelessly communicates with a wireless base station.

The display unit 104 is a component that administers a display interface for the audio playback apparatus, and is composed of a display device such as a liquid crystal display (LCD) or an organic electroluminescent (OEL) display. The display unit 104 may be additionally equipped with a light emitter such as a light-emitting diode (LED).

The operable unit 105 is a component that administers an input interface to the user, and includes multiple operable keys and/or a touch panel.

The memory 106 is an internal storage apparatus composed of RAM and flash memory, for example. The flash memory is non-volatile memory, and is used in order to store information such as operating system (OS) programs and control programs by which the controller 101 controls respective units, various application programs, and compressed music/motion image/still image data content, as well as various settings, font data, dictionary data, model name information, and device identification information, for example. In addition, other information may be stored, such as an address book registering the phone numbers, email addresses, home addresses, names, and facial photos of users, sent and received emails, and a scheduler registering a schedule for the user of the mobile device. The RAM stores temporary data as a work area when the controller 101 conducts various data processing and computations.

The external connection terminal 107 is a connector that connects to the cable 18 leading to the earphone 10*a*.

The external apparatus connection unit 170 is a component that controls the reading and writing of a removable external storage apparatus 171 with respect to the audio playback apparatus 100*a*. The external storage apparatus 171 is an external memory card such as what is called a Secure Digital (SD) card, for example. In this case, the external apparatus connection unit 170 includes a slot into which an external memory card may be inserted or removed, and conducts reading/writing control of data with respect to the external memory card, as well as signal processing.

The music data controller 173 is a component that reads and plays back music data stored in the external storage apparatus 171 or the memory 106. The music data controller 173 may also be configured to be able to write music data. Played-back music data may be converted into sound at the earphone 10*a* to enable listening.

The imaging controller 174 controls imaging by a built-in camera unit 175.

The GPS controller 176 functions as a position detector for receiving signals from given satellites with a GPS antenna 177 and obtaining position information (at least latitude and longitude information) for the current location.

The speaker 110 is an electroacoustic transducer for outputting telephony receiver audio, and converts an electrical signal into sound. The microphone unit (mic) 122 is a device for outputting telephony transmitter audio, and converts sound into an electrical signal.

In the case where the earphone 10*a* is connected to the audio playback apparatus 100*a*, an external speaker 421 and an external mic 422 inside the earphone 10*a* are used instead of the speaker 110 and the mic 122 built into the device. The external speaker 421 of the earphone 10*a* is connected to an earphone terminal 121 via the cable 18.

A geomagnetic sensor 131, an acceleration sensor 132, and a gyroscope 133 are also built into the audio playback apparatus 100*a*. These sensors are for detecting information such as the orientation and movement velocity of the audio playback apparatus 100, and are not directly used in the exemplary embodiments.

The earphone 10*a* includes the external speaker 421, the external mic 422, an external geomagnetic sensor 411, an external acceleration sensor 412, an external gyroscope 413, and an external connection controller 401. However, the external mic 422 and the external gyroscope 413 are not required elements in the exemplary embodiments.

The external connection controller 401 is connected to the respective sensors by a control line and a data line, while also being connected to the external connection terminal 107 of the audio playback apparatus 100 via the cable 18. Preferably, output from each sensor is acquired periodically or as necessary in response to a request from the audio playback apparatus 100, and transmitted to the audio playback apparatus 100 as sensor detection signals. More specifically, the external connection controller 401 includes various external connectors such as a connector according to the standard known as USB 2.0 (Universal Serial Bus 2.0), for example. For this reason, the audio playback apparatus is also equipped with a USB 2.0 controller.

Note that the audio playback apparatus 100*a* may also include various components which are not illustrated in FIG. 11, but which are provided in existing mobile devices.

Figure 12:
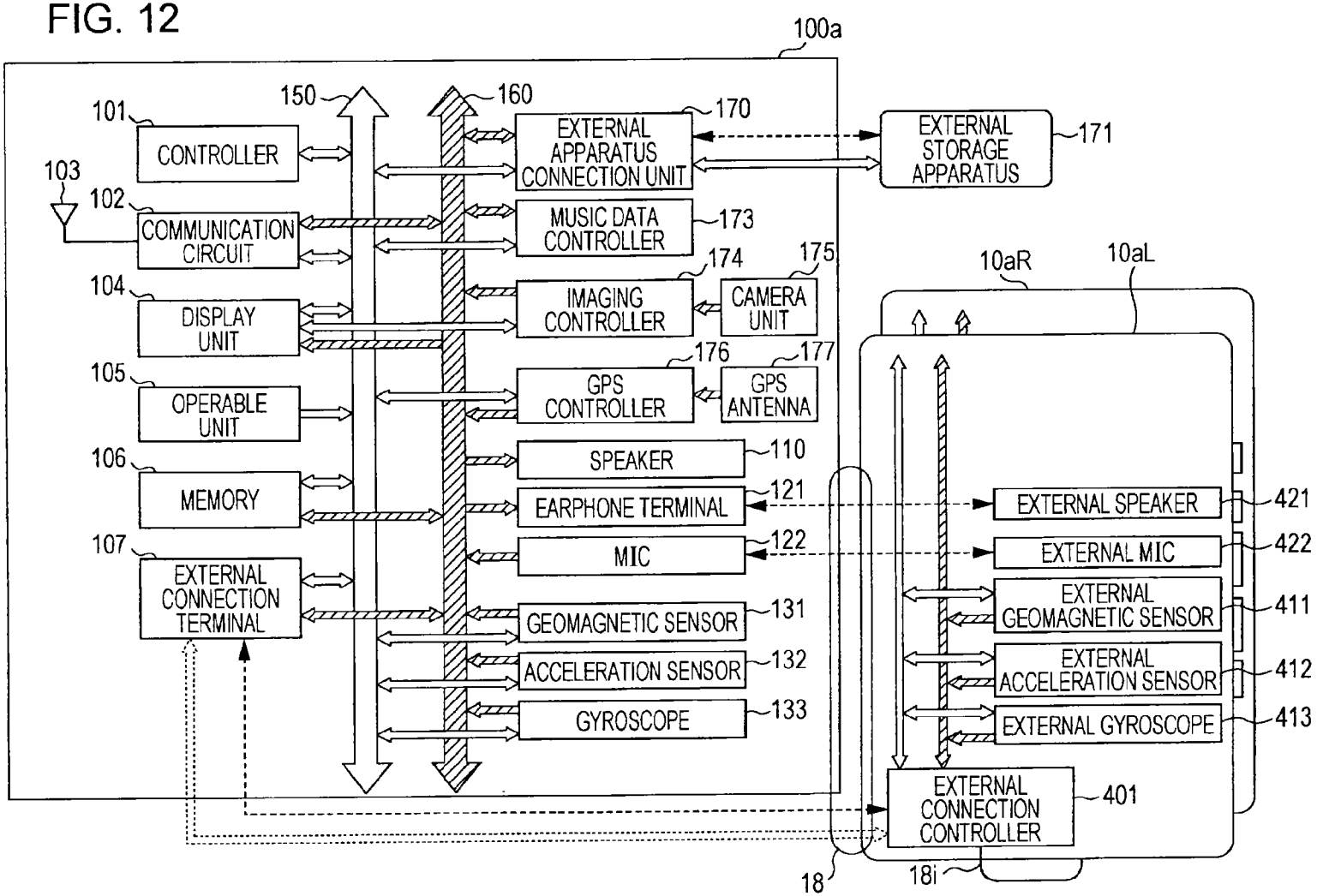
FIG. 12 is a diagram illustrating an exemplary configuration of an audio playback apparatus that uses wired earphones.

FIG. 12 illustrates an exemplary configuration of an audio playback apparatus 100*a* that uses wired earphones 10*a*L and 10*a*R. Since the configuration is generally the same as that of the audio playback apparatus 100*a* illustrated in FIG. 11, similar elements are denoted with the same reference signs, and duplicate description thereof will be reduced or omitted.

Generally, it is sufficient to provide the external geomagnetic sensor 411, the external acceleration sensor 412, and the external gyroscope 413 only in one of the earphones 10*a*L and 10*a*R. Obviously, these sensors may also be provided in both the left and right earphones. In this case, the question of whether to use both the left and right sensors or the sensors on one side only may differ by application.

Figure 13:
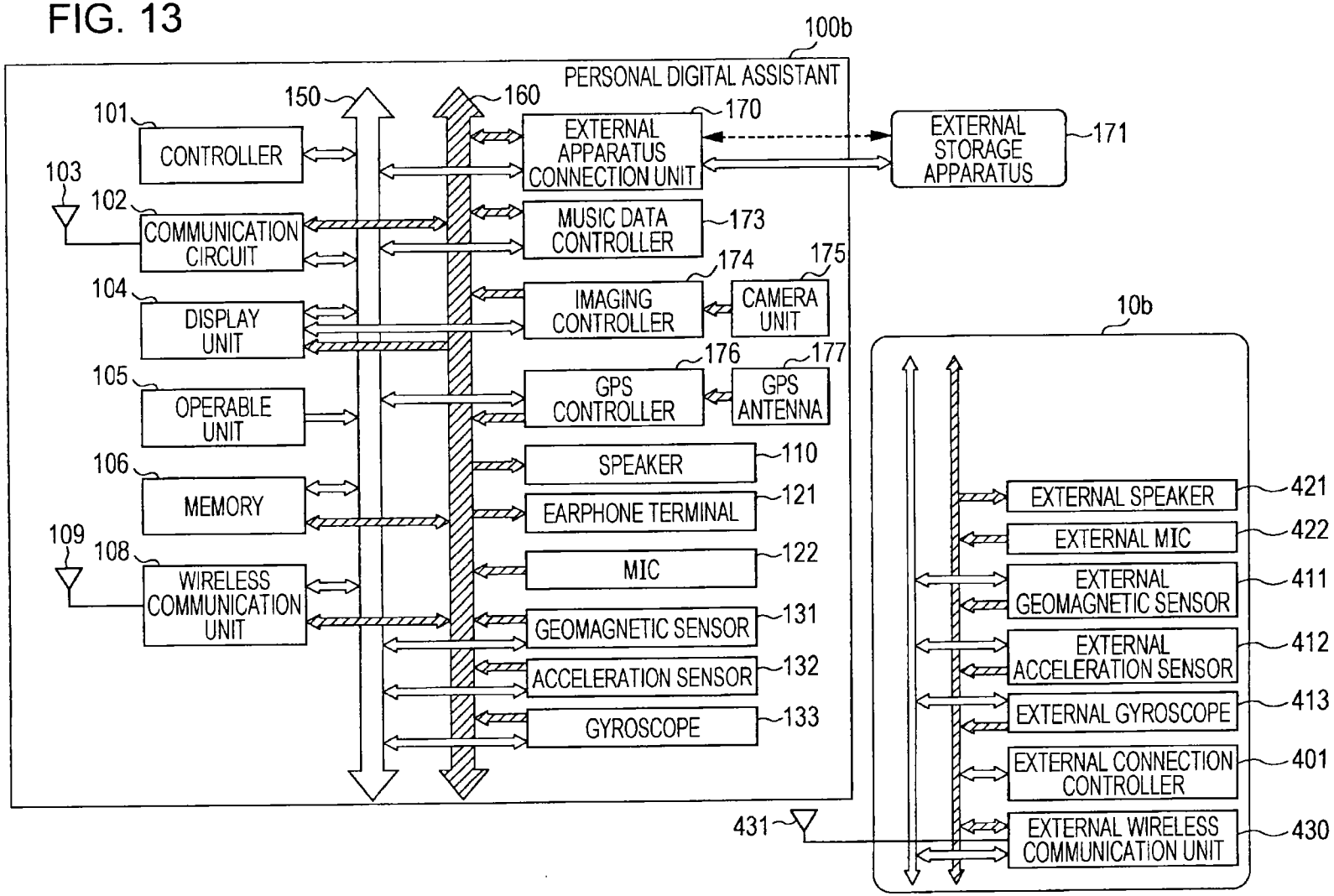
FIG. 13 is a diagram illustrating an exemplary configuration of an audio playback apparatus that uses a single wireless earphone.

FIG. 13 illustrates an exemplary configuration of an audio playback apparatus 100*b* that uses a single wireless earphone 10*b*. Since the configuration is generally the same as that of the audio playback apparatus 100*a* illustrated in FIG. 11, similar elements are denoted with the same reference signs, and duplicate description thereof will be reduced or omitted. Only the points that differ will be described.

The headphone 10*b* is equipped with an external wireless communication unit 430 and an external communication antenna 431, and wirelessly communicates with the antenna 109 of a wireless communication unit 108 in the audio playback apparatus 100*b*. The wireless communication is short-range wireless communication, and wireless communication is conducted over a comparatively short range according to a short-range wireless communication format such as Bluetooth (Bluetooth®), for example.

Figure 14:
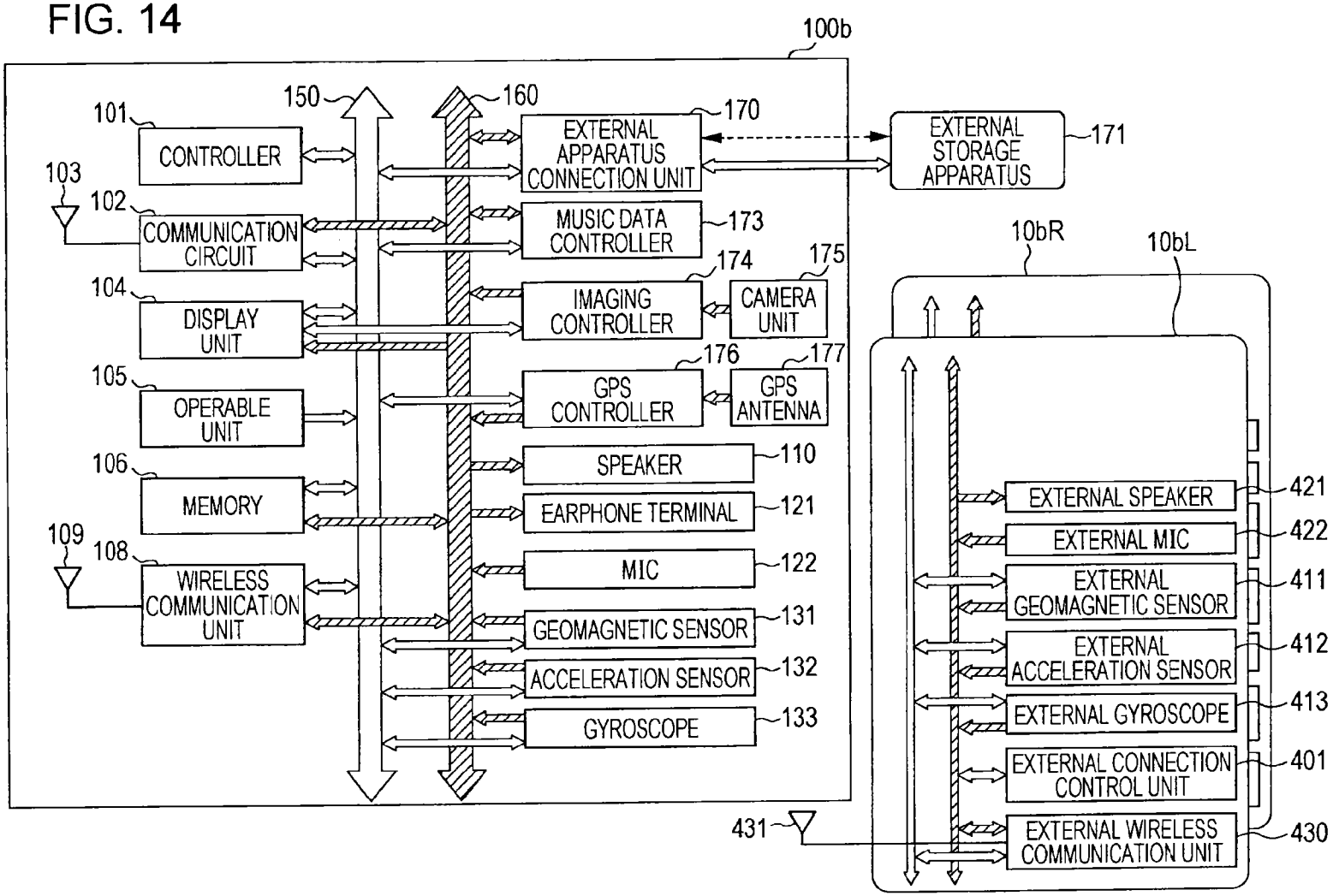
FIG. 14 is a diagram illustrating an exemplary configuration of an audio playback apparatus that uses left and right wireless earphones.

FIG. 14 illustrates an exemplary configuration of an audio playback apparatus 100*b* that uses wireless left and right earphones 10*b*L and 10*b*R. Since the configuration is generally the same as that of the audio playback apparatus 100*b* illustrated in FIG. 13, similar elements are denoted with the same reference signs, and duplicate description thereof will be reduced or omitted.

Generally, it is sufficient to provide the external geomagnetic sensor 411, the external acceleration sensor 412, and the external gyroscope 413 only in one of the earphones 10*b*L and 10*b*R. The earphone 10*b*L is equipped with an external wireless communication unit 430 and an external communication antenna 431, and wirelessly communicates with the antenna 109 of a wireless communication unit 108 in the mobile device 100*b*. The wireless communication is short-range wireless communication, and wireless communication is conducted over a comparatively short range according to a short-range wireless communication format such as Bluetooth (Bluetooth®), for example. Similarly to the earphone 10*b*L, the other earphone 10*b*R is equipped with an external wireless communication unit 430 and an external communication antenna 431, and wirelessly communicates with the antenna 109 of the wireless communication unit 108 in the mobile device 100*b*. In the case where the earphone 10*b*R and the earphone 10*ba* are connected by a cable (18*i*), it is sufficient to provide the external wireless communication unit 430 and the external communication antenna 431 in only one of the earphones.

Figure 15:
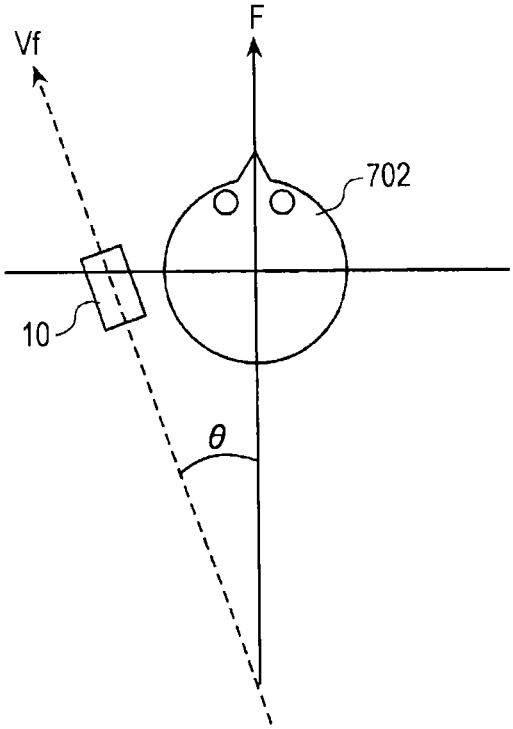
FIG. 15 is a diagram for explaining a method of more accurately computing the orientation of a user's face.

Hereinafter, a method of more accurately computing the orientation F of the user's face will be described. As illustrated in FIG. 15, the forward vector (Vf) of an earphone 10 does not necessarily match the orientation F of the user's face while in a state where the earphone 10 is being worn on the head of the user 702. Thus, when the user wears the earphone 10, the angle differential θ between the forward vector Vf and the orientation F of the face in the horizontal plane is computed and stored on the basis of output from the acceleration sensor 12. Thereafter, while the earphone is being worn, it is possible to compute a correct orientation F of the user's face at that time by correcting the direction of the forward vector Vf by the angle differential θ. Additionally, it is possible to compute the heading in which the user is facing at that time by referring to output from the geomagnetic sensor 11.

Figure 16:
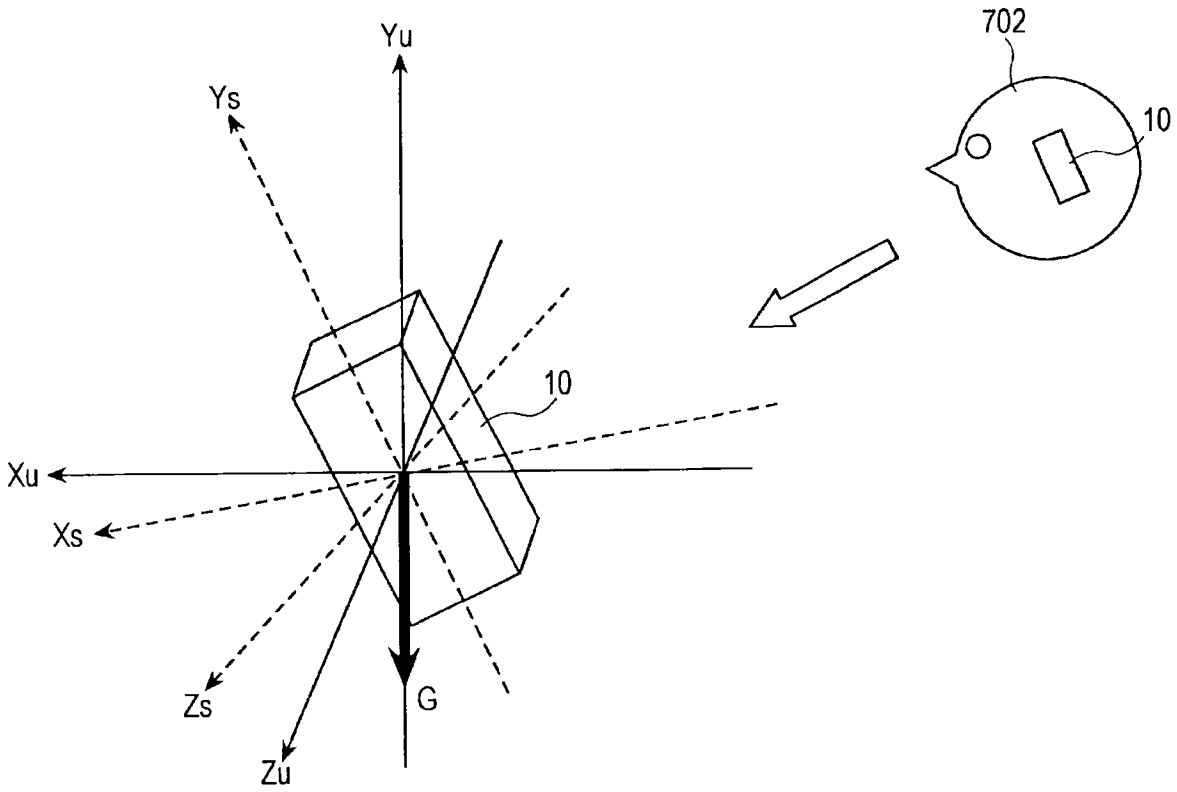
FIG. 16 is a diagram illustrating a state in which a user is wearing an earphone, as well as a sensor coordinate system and user coordinate system in such a state.

FIG. 16 once again illustrates a state in which the user 702 is wearing the earphone 10, as well as a sensor coordinate system and user coordinate system in such a state. The gravity vector G observed in the respective coordinate spaces may be expressed according to the following Eqs. 1 and 2.

[Math. 1]

$$Gu = \begin{pmatrix} Gxu \\ Gyu \\ Gzu \end{pmatrix} \tag{1}$$

[Math. 2]

$$Gs = \begin{pmatrix} Gxs \\ Gys \\ Gzs \end{pmatrix} \tag{2}$$

Figure 17:
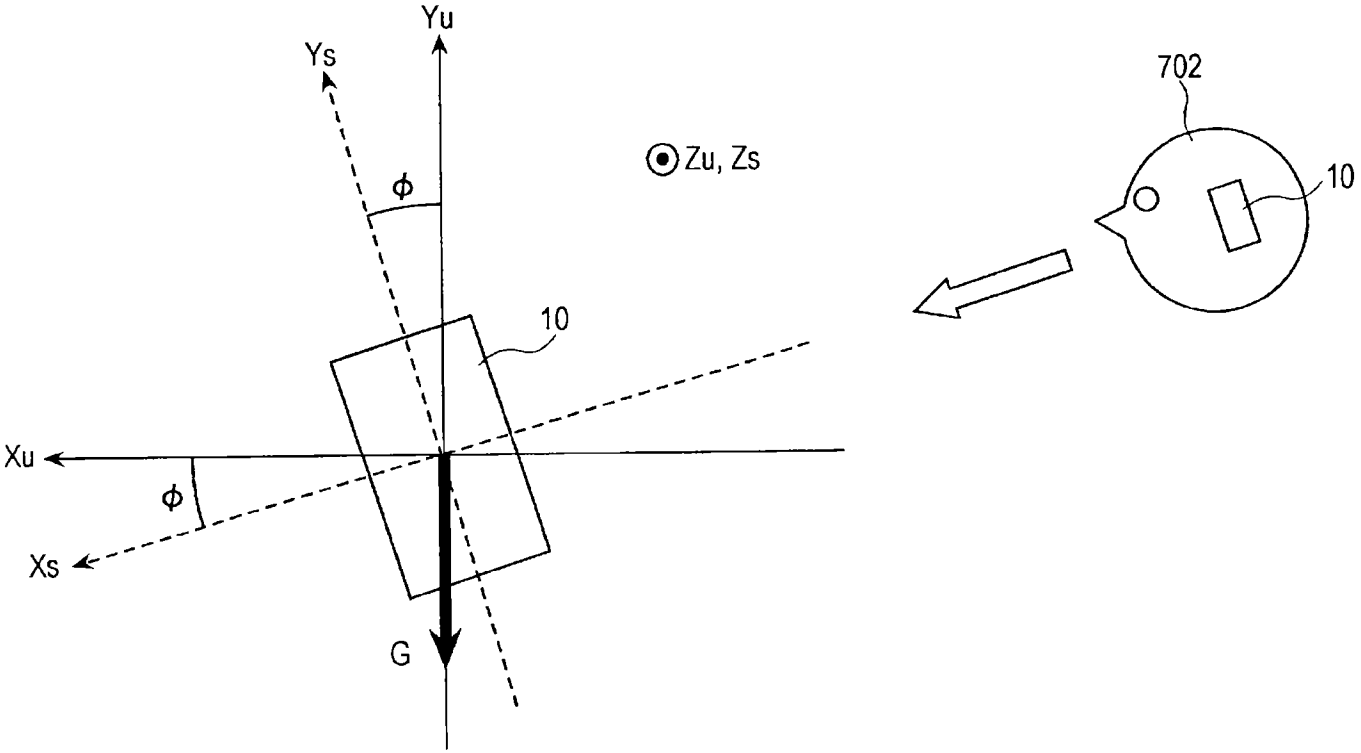
FIG. 17 is a diagram for explaining axis transformation by rotation of an earphone about the Z axis.

As illustrated in FIG. 17, axis transformation by rotation of the earphone 10 about the Z axis is expressed in the following Eq. 3.

[Math. 3]

$$\begin{pmatrix} Gxs \\ Gys \\ Gzs \end{pmatrix} = \begin{pmatrix} Gxu \\ Gyu \\ Gzu \end{pmatrix} \begin{pmatrix} \cos\phi & -\sin\phi & 0 \\ \sin\phi & \cos\phi & 0 \\ 0 & 0 & 1 \end{pmatrix} \tag{3}$$

Herein, the angle ϕ represents the tilt angle about the Z axis of the Ys axis of the earphone 10 with respect to the Yu axis. In this case, the Zs axis and the Zu axis are taken to approximately match. Gxs, Gys, and Gzs are the axial components of the gravity vector G in the sensor coordinate system, while Gxu, Gyu, and Gzu are the axial components of the gravity vector G in the user coordinate system.

Figure 18:
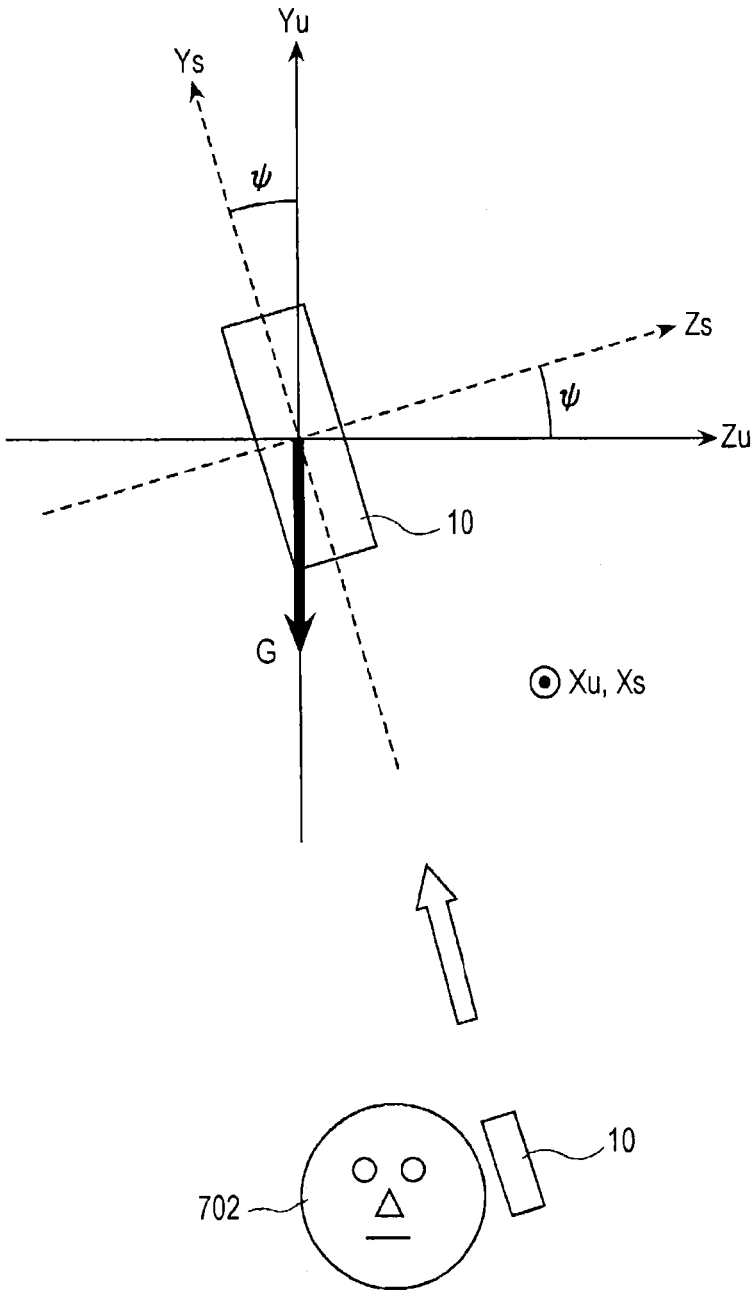
FIG. 18 is a diagram for explaining axis transformation by rotation of an earphone about the X axis.

Similarly, as illustrated in FIG. 18, axis transformation by rotation of the earphone 10 about the X axis is expressed in the following Eq. 4.

[Math. 4]

$$\begin{pmatrix} Gxs \\ Gys \\ Gzs \end{pmatrix} = \begin{pmatrix} Gxu \\ Gyu \\ Gzu \end{pmatrix} \begin{pmatrix} 1 & 0 & 0 \\ 0 & \cos\psi & -\sin\psi \\ 0 & \sin\psi & \cos\psi \end{pmatrix} \tag{4}$$

Herein, the angle ψ represents the tilt angle about the X axis of the Ys axis of the earphone 10 with respect to the Yu axis. In this case, the Xs axis and the Xu axis are taken to approximately match.

Figure 19:
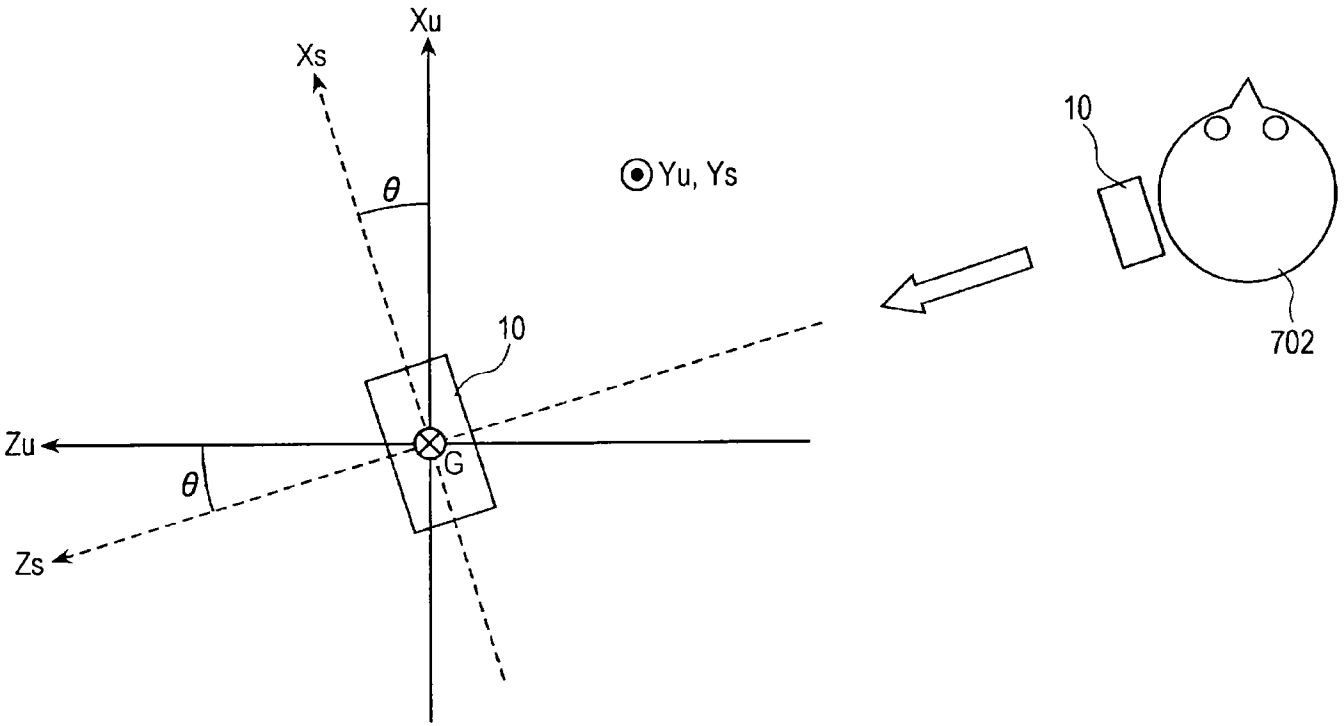
FIG. 19 is a diagram for explaining axis transformation by rotation of an earphone about the Y axis.

Also similarly, as illustrated in FIG. 19, axis transformation by rotation of the earphone 10 about the Y axis is expressed in the following Eq. 5.

[Math. 5]

$$\begin{pmatrix} Gxs \\ Gys \\ Gzs \end{pmatrix} = \begin{pmatrix} Gxu \\ Gyu \\ Gzu \end{pmatrix} \begin{pmatrix} \cos\theta & 0 & \sin\theta \\ 0 & 1 & 0 \\ -\sin\theta & 0 & \cos\theta \end{pmatrix} \tag{5}$$

Herein, the angle θ represents the tilt angle about the Y axis of the Xs axis of the earphone 10 with respect to the Xu axis. In this case, the Ys axis and the Yu axis are taken to approximately match.

An axis transformation that takes into account the three angles ϕ, ψ, and θ from Eqs. 3, 4, and 5 is expressed in the following Eq. 6.

[Math. 6]

$$\begin{pmatrix} Gxs \\ Gys \\ Gzs \end{pmatrix} = \begin{pmatrix} Gxu \\ Gyu \\ Gzu \end{pmatrix} \begin{pmatrix} \cos\phi & -\sin\phi & 0 \\ \sin\phi & \cos\phi & 0 \\ 0 & 0 & 1 \end{pmatrix} \begin{pmatrix} 1 & 0 & 0 \\ 0 & \cos\psi & -\sin\psi \\ 0 & \sin\psi & \cos\psi \end{pmatrix} \begin{pmatrix} \cos\theta & 0 & \sin\theta \\ 0 & 1 & 0 \\ -\sin\theta & 0 & \cos\theta \end{pmatrix} = \begin{pmatrix} Gxu(\cos\phi\cos\theta - \sin\phi\cos\psi\sin\theta) - Gyu(\sin\phi\cos\psi) + Gzu(\cos\phi\sin\theta + \sin\phi\sin\psi\cos\theta) \\ Gxu(\sin\phi\cos\theta + \cos\phi\sin\psi\sin\theta) + Gyu(\cos\phi\cos\psi) + Gzu(\cos\phi\sin\theta + \sin\phi\sin\psi\cos\theta) \\ -Gxu(\cos\psi\sin\theta) + Gyu(\sin\psi) + Gzu(\cos\psi\cos\theta) \end{pmatrix} \quad (6)$$

At this point, if g is taken to be a constant expressing the absolute value of the gravitational force, the expression becomes like the following Eq. 7.

[Math. 7]

$$Gu = \begin{pmatrix} Gxu \\ Gyu \\ Gzu \end{pmatrix} = \begin{pmatrix} 0 \\ -g \\ 0 \end{pmatrix} \quad (7)$$

Substituting this Gu into Eq. 6 yields the following Eq. 8.

[Math. 8]

$$\begin{pmatrix} Gxs \\ Gys \\ Gzs \end{pmatrix} = \begin{pmatrix} g\sin\phi\cos\psi \\ -g\cos\phi\cos\psi \\ -g\sin\psi \end{pmatrix} \quad (8)$$

At this point, since g is a constant and the axial values Gxs, Gys, and Gzs of Gs are ascertained from the output of the acceleration sensor, the angles $\phi$ and $\psi$ can be computed. However, the angle $\theta$ cannot be computed.

Figure 20:
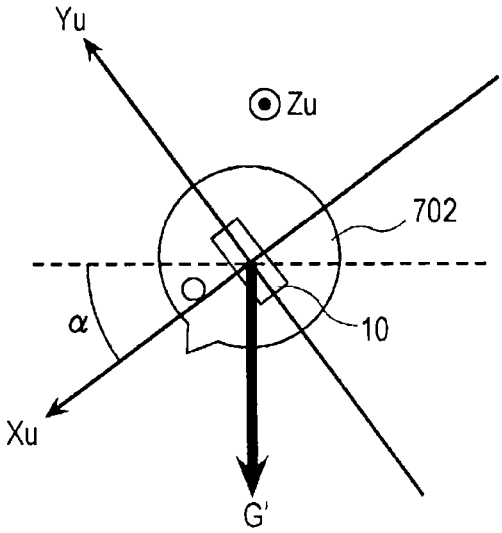
FIG. 20 is a diagram for explaining a nodding gesture that a user is made to execute in a state of wearing an earphone.

Thus, as illustrated in FIG. 20, the user is made to execute a nodding gesture while in a state of wearing the earphone. In this specification, a nodding gesture refers to a gesture in which the user looks directly ahead with respect to his or her body, rotates his or her head forward from an upright state by a given angle or more, and then returns his or her head to its original upright state. With this gesture, the vertical plane containing the vector expressing the orientation F of the user's face is determined.

More specifically, when the user's head rotates in the vertical plane during the nodding gesture, the maximum rotational angle of the user's head with respect to the horizontal plane (the Xu-Yu plane), or in other words the maximum nodding angle $\alpha$, is computed. The way to compute this angle $\alpha$ will be discussed later. The gravity vector at the moment of this maximum nodding angle $\alpha$ is taken to be a gravity vector G'. G'u may be expressed like the following Eq. 9.

[Math. 9]

$$G'u = \begin{pmatrix} G'xu \\ G'yu \\ G'zu \end{pmatrix} = \begin{pmatrix} g\sin\alpha \\ -g\cos\alpha \\ 0 \end{pmatrix} \quad (9)$$

Substituting this G'u (in other words, G'xu, G'yu, and G'zu) into the above Eq. 6 yields the following Eq. 10.

[Math. 10]

$$\begin{pmatrix} G'xs \\ G'ys \\ G'zs \end{pmatrix} = \begin{pmatrix} g\sin\alpha(\cos\phi\cos\theta - \sin\phi\cos\psi\sin\theta) + g\cos\alpha(\sin\phi\cos\psi) \\ g\sin\alpha(\sin\phi\cos\theta + \cos\phi\sin\psi\sin\theta) - g\cos\alpha(\cos\phi\cos\psi) \\ -g\sin\alpha(\cos\psi\sin\theta) - g\cos\alpha(\sin\psi) \end{pmatrix} \quad (10)$$

The value of G's (in other words, G'xs, G'ys, and G'zs) is obtained from the output values of the acceleration sensor, and the values of the angles $\phi$ and $\psi$ are known in the state before the nod. As a result, the angle $\theta$ can be computed. With this angle $\theta$, it is possible to correct error in the orientation of the user's face based on the forward direction of the earphone.

Figure 21:
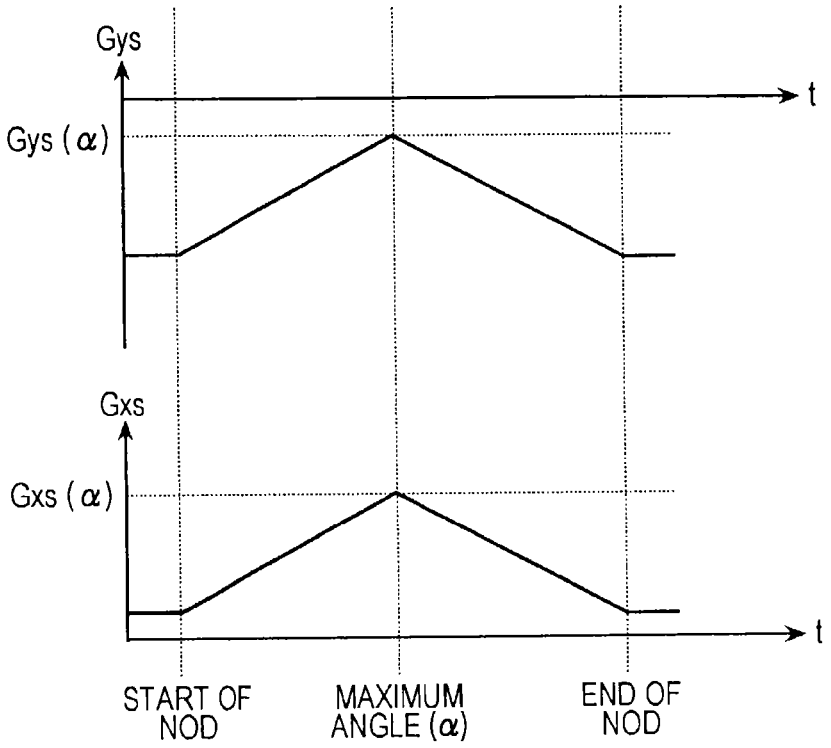
FIG. 21 is a graph illustrating change in the gravity-induced acceleration components Gys and Gxs during a nodding gesture.

The way of computing the maximum nodding angle $\alpha$ will now be described. FIG. 21 illustrates change in the gravity-induced acceleration components Gys and Gxs during a nodding gesture. Both graphs are obtained by monitoring the X axis and Y axis sensor output from the acceleration sensor over a given interval at a given sampling period. As the graphs demonstrate, the extrema (maximum values) Gys($\alpha$) and Gxs ($\alpha$) appear in the sensor output at the moment of the maximum nodding angle $\alpha$. Thus, it is possible to compute the angle $\alpha$ by monitoring for such extrema.

The maximum value is used because the precision of the computed angle decreases for non-maximum values due to noise in the acceleration value from the inertial moment while the acceleration sensor is rotating due to the nodding gesture. At the maximum angle, sensor motion momentarily stops, and noise is minimized.

A gyroscope may be used to further raise the detection precision for the maximum nodding angle $\alpha$. Taking the rotational direction of the gyroscope during a nodding gesture to be about the a axis, the value of the gyroscope output Gyro-a varies like the sine waveform illustrated in FIG. 22 during the nodding gesture. At the moment when the nodding gesture by the user's head reaches the maximum angle, the gyroscope rotation stops, and its output becomes 0. For this reason, it becomes possible to more precisely compute the angle $\alpha$ by reading the output from the acceleration sensor at the point when the gyroscope output Gyro-a becomes 0 (the zero-crossing point). However, use of a gyroscope is not required in the present disclosure.

Figure 22:
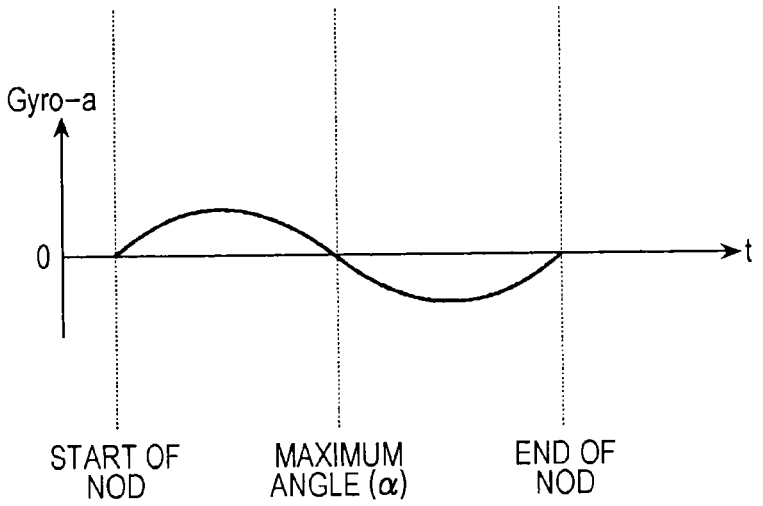
FIG. 22 is a graph illustrating change in the output Gyro-a from a gyroscope during a nodding gesture.

The user is made to execute the nodding gesture as an initial gesture when the user puts on the earphone (headphone) and starts execution of the application to be used, particularly when starting execution of an application that utilizes the orientation F of the user's face, or at a given time, such as when connecting an earphone to an audio playback apparatus. For this reason, it may be configured such that explicit instructions for performing the nodding gesture are indicated by the user interface with a display or sound (or voice) at every instance of such a given time. Alternatively, the user may be informed of the necessity of a nodding gesture manually or otherwise as determined by the application. It may also be configured such that when a given nodding gesture is conducted and the expected goal is achieved, the user is informed to that effect with a display or sound (or voice). The given nodding gesture may be conducted by confirming change in the sensor output as illustrated in FIGS. 21 and 22, for example. In addition, an incorrect gesture may be determined in the case where the given angle $\alpha$ is greater than a predetermined angle. It may also be configured such that the user is instructed to retry the nodding gesture with a display or sound (or voice) in the case where the given nodding gesture and the given angle $\alpha$ are not detected after a given amount of time has elapsed since starting execution of the application.

In this way, even in the case where the earphone wearing angle with respect to the user is offset from the expected wearing position in the XY plane and the YZ plane (the case where $\phi \neq 0$ and $\psi \neq 0$), such tilt can be determined by the output from the acceleration sensor, as discussed above. Consequently, the tilt $\theta$ in the XZ plane is similarly and uniquely determined by the nodding gesture, even from such an offset state.

Figure 23:
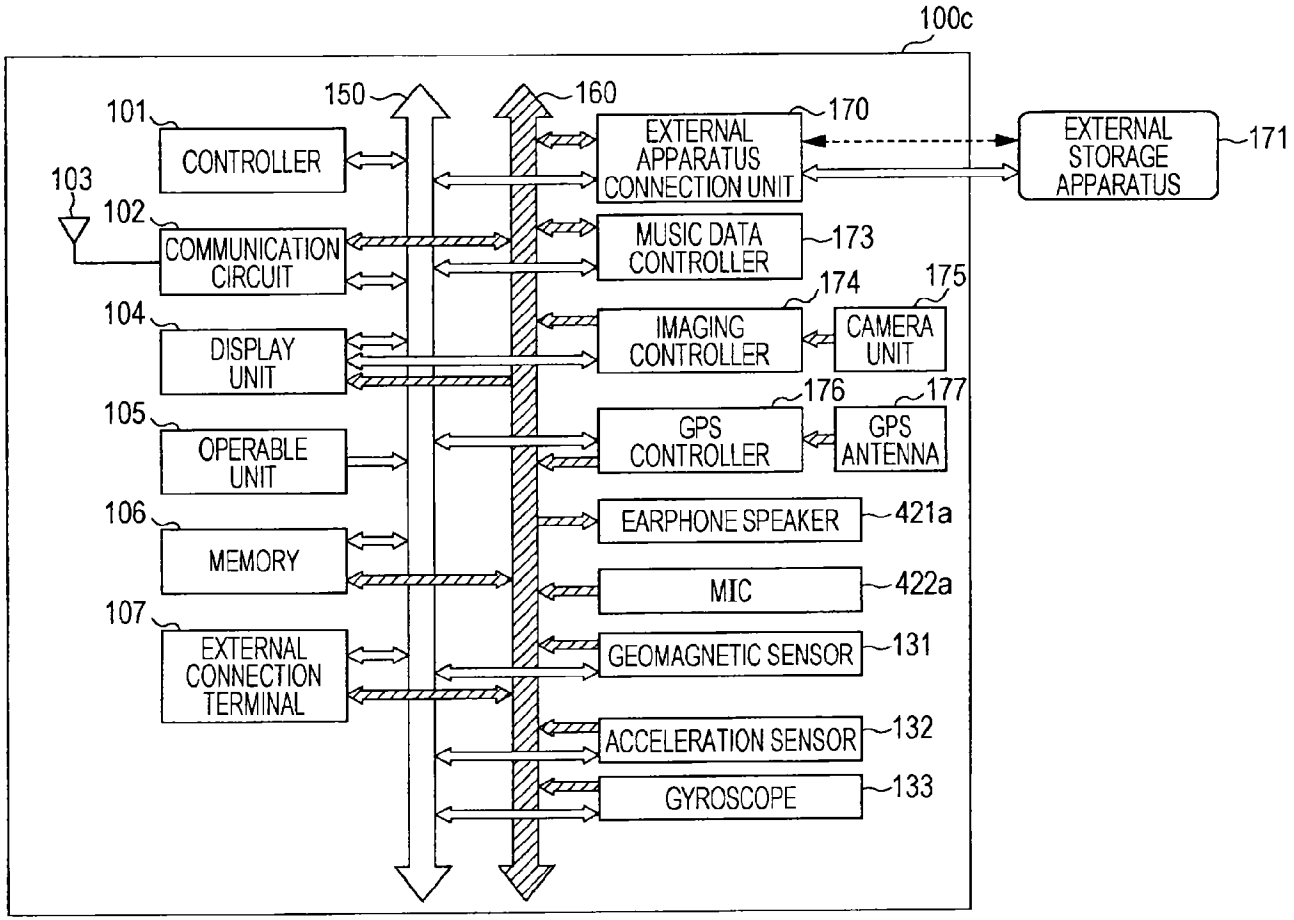
FIG. 23 is a diagram illustrating an exemplary configuration of an audio playback apparatus with an integrated headphone (earphone).

The foregoing description envisions the case where the audio playback apparatus and the headphone (earphone) are separate. However, a configuration in which the functionality of the audio playback apparatus is built into a headphone is also conceivable. FIG. 23 illustrates an exemplary configuration of such an audio playback apparatus 100*c* with an integrated headphone. This apparatus may also be interpreted to be a headphone with built-in audio playback apparatus functionality.

An earphone speaker 421*a* and mic 422*a* are attached to the housing of the audio playback apparatus 100*c*.

Figure 24:
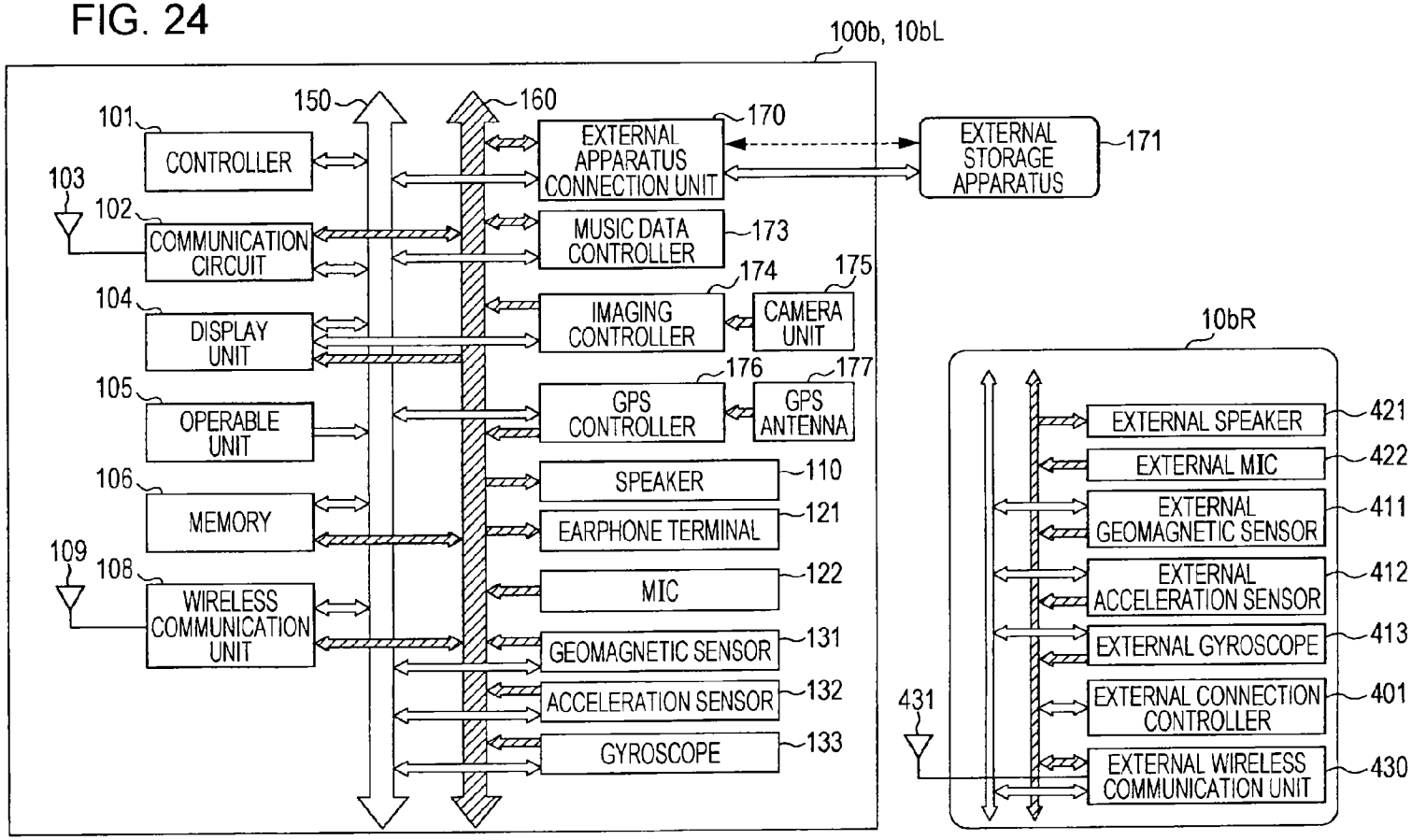
FIG. 24 is a diagram illustrating an exemplary configuration of an audio playback apparatus with integrated headphones (earphones), for the case of stereo headphones.

As illustrated in FIG. 24, in the case of stereo headphones, the configuration in FIG. 23 may be included in only one of the left and right earphones 10*b*L and 10*b*R (in this example, 10*b*L). In this case, the earphone 10*b*L is equipped with the wireless communication unit 108 instead of the external connection terminal 107, and is wirelessly connected to the other earphone 10*b*R. Alternatively, although not illustrated, the earphones may be connected to each other in a wired manner via the external connection terminal 107.

Note that not all of the components illustrated are required as the audio playback apparatus 100*c*. Furthermore, other components which are not illustrated, but which are provided in existing audio playback apparatus, may also be included.

Next, a second exemplary embodiment of the present disclosure will be described. The configurations of an audio playback apparatus and a headphone (earphone) in the second exemplary embodiment are similar to those of the first exemplary embodiment.

Ordinarily, the two earphones in a set of stereo headphones are statically determined in advance to be a left earphone and a right earphone, respectively. For this reason, when using the headphones, the user puts on the headphones by visually checking the left and right earphones. If the user mistakenly wears the headphones backwards, not only will the left and right stereo audio be reversed, but the detection results based on sensor output will be off by approximately 180°, and there is a risk of no longer being able to expect correct operation.

Also, in the case where the two earphones in a set of headphones are not distinguished as left and right, it must be confirmed which earphone is being worn on which ear (left or right) while being worn on the user's head, and stereo audio must be correctly transmitted. Consequently, it would be convenient to be able to detect, on the basis of sensor output, whether each earphone is being worn on the user's left or right ear.

Figure 25:
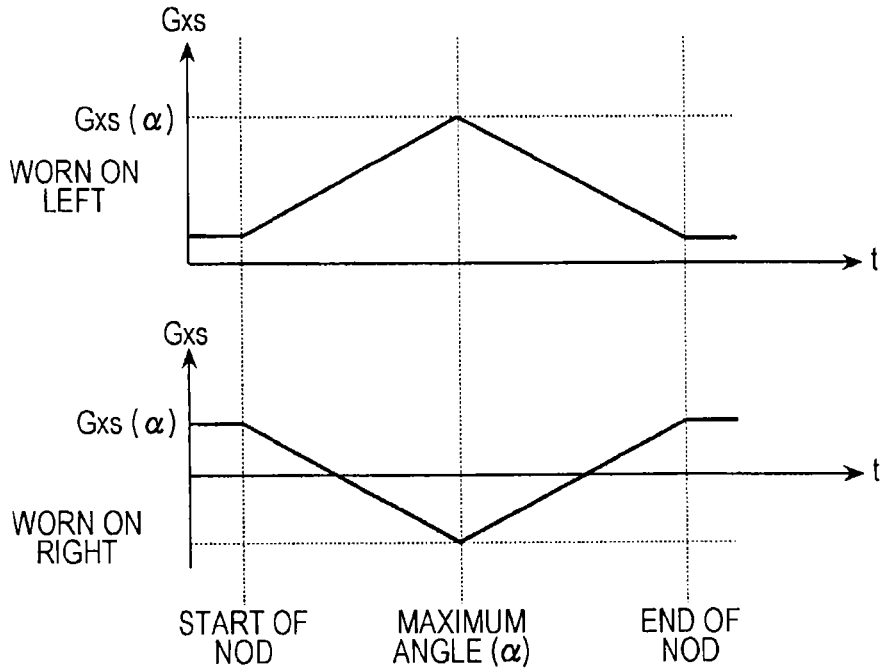
FIG. 25 is a graph illustrating change in the sensor output for a specific axis of an acceleration sensor when the user performs a nodding gesture in the second exemplary embodiment of the present disclosure.

FIG. 25 illustrates, for an earphone able to be worn on either the left or right ear, change in the sensor output for a specific axis (in the drawing, the Xs axis) of an acceleration sensor when the user performs a nodding gesture in the case of wearing the earphone on the user's left ear and in the case of wearing the earphone on the right ear. When worn on the left, the X axis output from a 3-axis acceleration sensor exhibits convex variation as it varies from the start time to the end time of a nodding gesture, increasing at first but then decreasing after reaching a maximum value, and returning to the initial value. Conversely, when worn on the right, the X axis output from the 3-axis acceleration sensor exhibits concave variation as it varies from the start time to the end time of a nodding gesture, decreasing at first but then increasing after reaching a minimum value, and returning to the initial value.

Consequently, it is possible to determine whether an earphone is being worn on the user's left ear or right ear, depending on whether the sensor output for a specific axis (herein, the Xs axis or the Ys axis) of an acceleration sensor exhibits convex variation or concave variation during a nodding gesture.

Figure 26:
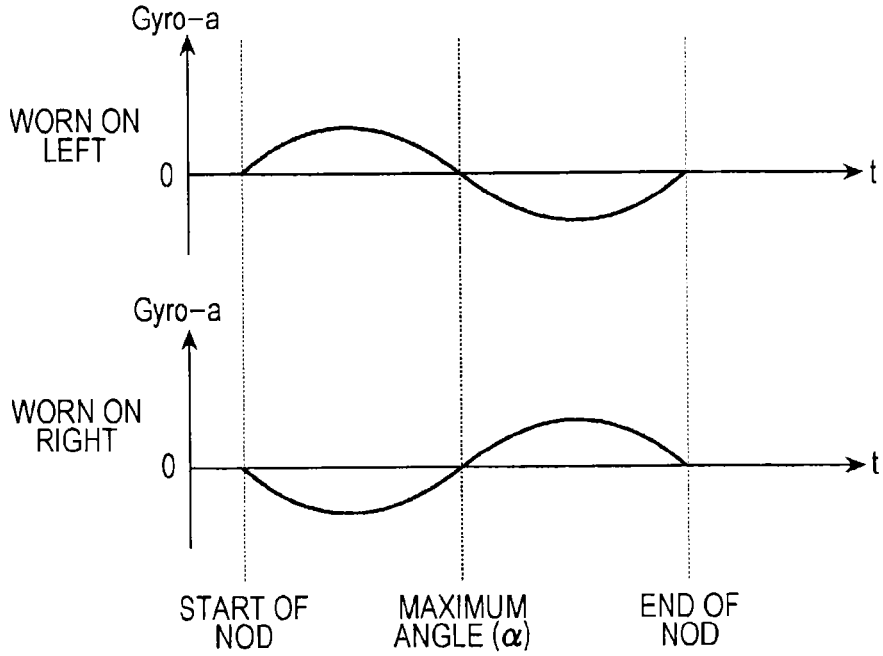
FIG. 26 is an explanatory diagram for the case of jointly using a gyroscope with an acceleration sensor in the second exemplary embodiment.

FIG. 26 is an explanatory diagram for the case of jointly using a gyroscope with an acceleration sensor. The motion of a gyroscope about the axis of the nodding rotational direction is reversed when the same earphone is worn on the left ear and worn on the right ear. In other words, the phase of the waveform in the gyroscope output differs by 180° when an earphone is worn on the left and worn on the right. In the example in the drawing, it is possible to determine whether the earphone is being worn on the left or worn on the right depending on whether the waveform changes from positive to negative or from negative to positive at the zero-crossing.

In this way, by causing the user to perform a nodding gesture while wearing an earphone, it is ascertained whether that earphone is being worn on the left ear or being worn on the right ear. In the case where an earphone is a predetermined left-ear or right-ear earphone, and that left/right distinction does not match the detected left/right distinction, the user may be warned to that effect by the user interface with a display or sound.

Also, in the case where two earphones are not distinguished as left and right, and may be worn on arbitrary sides, it is determined which earphone is being worn on which side after the user puts on the earphones. An audio playback apparatus may be configured to subsequently conduct a switching control on the basis of the detected results, so as to send left or right audio output to the earphone on the corresponding side.

Although the foregoing describes preferred embodiments of the present disclosure, it is possible to perform various alterations or modifications other than those mentioned above. In other words, it is to be understood as obvious by persons skilled in the art that various modifications, combinations, and other embodiments may occur depending on design or other factors insofar as they are within the scope of the claims or their equivalents.

For example, although the gyroscope is described in the foregoing as not being required among the multiple sensors on board an earphone, the geomagnetic sensor is also unnecessary if there is no need to compute the heading in which the user's face is facing.

A feature of the second exemplary embodiment is the determination of whether an earphone is being worn on the user's left ear or right ear, depending on whether the output for a specific axis of the 3-axis acceleration sensor that varies during the nodding gesture exhibits convex variation or concave variation. However, this feature does not require actually computing the nodding angle $\alpha$, and may be established independently of the features of the first exemplary embodiments.

The present disclosure also encompasses a computer program for realizing the functionality described in the foregoing exemplary embodiments with a computer, as well as a recording medium storing such a program in a computer-readable format. Potential examples of such a recording medium for supplying the program include magnetic storage media (such as a flexible disk, hard disk, or magnetic tape), optical discs (such as an MO, PD, or other magneto-optical disc, a CD, or a DVD), and semiconductor storage, for example.

The invention claimed is:

1. An information processing apparatus comprising:

circuitry configured to detect an output from a 3-axis acceleration sensor included in an earphone unit worn by a user while the user is in a still state;

monitor the output of the 3-axis acceleration sensor while a nodding gesture is performed by the user;

detect a time when an angle of the nodding gesture reaches a maximum by detecting an extremum in the output for a specific axis of the 3-axis acceleration sensor that varies during the nodding gesture; and determine an earphone wearing state based on the output from the 3-axis acceleration sensor in the still state and the output from the 3-axis acceleration sensor at the time of detecting the maximum nodding angle.

2. The information processing apparatus of claim 1, wherein the circuitry is configured to:

detect the time when the angle of the nodding gesture reaches the maximum by detecting a zero-crossing of a gyroscope included in the earphone unit that varies during the nodding gesture.

3. The information processing apparatus of claim 1, wherein the circuitry is configured to:

determine whether the earphone unit is being worn on the user's left ear or right ear based on whether an output corresponding to a specific axis of the 3-axis acceleration sensor that varies during the nodding gesture exhibits convex variation or concave variation.

4. The information processing apparatus of claim 1, wherein provided that three mutually orthogonal axes of an earphone unit-specific three-dimensional coordinate system are an Xs axis, a Ys axis, and a Zs axis, that mutually orthogonal axes of a three-dimensional coordinate system in which the user is disposed are an Xu axis, a Yu axis, and a Zu axis, in which the Xs axis corresponds to a front and back direction of the earphone unit, the Ys axis corresponds to a top and bottom direction of the earphone, the Zs axis is orthogonal to the Xs axis and the Ys axis, the Xu axis corresponds to a front and back direction of the user, the Yu axis corresponds to a top and bottom direction of the user, and the Zu axis is orthogonal to the Xu axis and the Yu axis, and provided that $\phi$ is a tilt angle of the Ys axis with respect to the Yu axis about the Z axis in both coordinate systems, that $\psi$ is a tilt angle of the Ys axis with respect to the Yu axis about the X axis in both coordinate systems, and that $\theta$ is a tilt angle of the Xs axis with respect to the Xu axis about the Y axis in both coordinate systems when the user is wearing the earphone unit, the circuitry is further configured to:

compute a maximum nodding angle $\alpha$ based on the extremum;

compute the angles $\phi$ and $\psi$ based on gravitational acceleration and an output of the 3-axis acceleration sensor while the user is in the still state; and compute the angle $\theta$ based on the angles $\phi$, $\psi$, and $\alpha$ as well as the output of 3-axis acceleration sensor when the extremum is detected for the specific axis of the 3-axis acceleration sensor that varies during the nodding gesture.

5. A method comprising:

detecting an output from a 3-axis acceleration sensor included in an earphone unit worn by a user while the user is in a still state;

monitoring the output of the 3-axis acceleration sensor while a nodding gesture is performed by the user;

detecting a time when an angle of the nodding gesture reaches a maximum by detecting an extremum in the output for a specific axis of the 3-axis acceleration sensor that varies during the nodding gesture; and determining, by circuitry, an earphone wearing state based on the output from the 3-axis acceleration sensor in the still state and the output from the 3-axis acceleration sensor at the time of detecting the maximum nodding angle.

6. The method of claim 5, wherein detecting the time when the angle of the nodding gesture reaches the maximum includes detecting a zero-crossing of a gyroscope included in the earphone unit that varies during the nodding gesture.

7. The method of claim 5, further comprising:

determining whether the earphone unit is being worn on the user's left ear or right ear based on whether an output corresponding to a specific axis of the 3-axis acceleration sensor that varies during the nodding gesture exhibits convex variation or concave variation.

8. The method of claim 5, wherein provided that three mutually orthogonal axes of an earphone unit-specific three-dimensional coordinate system are an Xs axis, a Ys axis, and a Zs axis, that mutually orthogonal axes of a three-dimensional coordinate system in which the user is disposed are an Xu axis, a Yu axis, and a Zu axis, in which the Xs axis corresponds to a front and back direction of the earphone unit, the Ys axis corresponds to a top and bottom direction of the earphone, the Zs axis is orthogonal to the Xs axis and the Ys axis, the Xu axis corresponds to a front and back direction of the user, the Yu axis corresponds to a top and bottom direction of the user, and the Zu axis is orthogonal to the Xu axis and the Yu axis, and provided that $\phi$ is a tilt angle of the Ys axis with respect to the Yu axis about the Z axis in both coordinate systems, that $\psi$ is a tilt angle of the Ys axis with respect to the Yu axis about the X axis in both coordinate systems, and that $\theta$ is a tilt angle of the Xs axis with respect to the Xu axis about the Y axis in both coordinate systems when the user is wearing the earphone unit, the method further comprising:

computing a maximum nodding angle $\alpha$ based on the extremum;

computing the angles $\phi$ and $\psi$ based on gravitational acceleration and an output of the 3-axis acceleration sensor while the user is in the still state; and computing the angle $\theta$ based on the angles $\phi$, $\psi$, and $\alpha$ as well as the output of 3-axis acceleration sensor when the extremum is detected for the specific axis of the 3-axis acceleration sensor that varies during the nodding gesture.

9. A non-transitory computer readable medium including computer-program instructions, which when executed by an information processing apparatus, cause the information processing apparatus to:

detect an output from a 3-axis acceleration sensor included in an earphone unit worn by a user while the user is in a still state;

monitor the output of the 3-axis acceleration sensor while a nodding gesture is performed by the user;

detect a time when an angle of the nodding gesture reaches a maximum by detecting an extremum in the output for a specific axis of the 3-axis acceleration sensor that varies during the nodding gesture; and determine an earphone wearing state based on the output from the 3-axis acceleration sensor in the still state and the output from the 3-axis acceleration sensor at the time of detecting the maximum nodding angle.

10. The non-transitory computer readable medium of claim 9, the computer-program instructions causing the information processing apparatus to:

detect the time when the angle of the nodding gesture reaches the maximum by detecting a zero-crossing of a gyroscope included in the earphone unit that varies during the nodding gesture.

11. The non-transitory computer readable medium of claim 9, the computer-program instructions causing the information processing apparatus to:

determine whether the earphone unit is being worn on the user's left ear or right ear based on whether an output corresponding to a specific axis of the 3-axis acceleration sensor that varies during the nodding gesture exhibits convex variation or concave variation.

12. The non-transitory computer readable medium of claim 9, wherein provided that three mutually orthogonal axes of an earphone unit-specific three-dimensional coordinate system are an Xs axis, a Ys axis, and a Zs axis, that mutually orthogonal axes of a three-dimensional coordinate system in which the user is disposed are an Xu axis, a Yu axis, and a Zu axis, in which the Xs axis corresponds to a front and back direction of the earphone unit, the Ys axis corresponds to a top and bottom direction of the earphone, the Zs axis is orthogonal to the Xs axis and the Ys axis, the Xu axis corresponds to a front and back direction of the user, the Yu axis corresponds to a top and bottom direction of the user, and the Zu axis is orthogonal to the Xu axis and the Yu axis, and provided that $\phi$ is a tilt angle of the Ys axis with respect to the Yu axis about the Z axis in both coordinate systems, that $\psi$ is a tilt angle of the Ys axis with respect to the Yu axis about the X axis in both coordinate systems, and that $\theta$ is a tilt angle of the Xs axis with respect to the Xu axis about the Y axis in both coordinate systems when the user is wearing the earphone unit, the computer-program instructions causing the information processing apparatus to:

compute a maximum nodding angle $\alpha$ based on the extremum;

compute the angles $\phi$ and w based on gravitational acceleration and an output of the 3-axis acceleration sensor while the user is in the still state; and compute the angle $\theta$ based on the angles $\phi$, $\psi$, and $\alpha$ as well as the output of 3-axis acceleration sensor when the extremum is detected for the specific axis of the 3-axis acceleration sensor that varies during the nodding gesture.

* * * * *